US008226136B2

(12) United States Patent
Mills et al.

(10) Patent No.: US 8,226,136 B2
(45) Date of Patent: Jul. 24, 2012

(54) METHOD AND APPARATUS FOR EFFECTING RELATIVE MOVEMENT OF CONTAINERS

(75) Inventors: Robert Arthur Mills, Lancashire (GB); Ghee Hua Ng, Singapore (SG); ZhanMin Tong, Singapore (SG)

(73) Assignee: NSL Engineering Pte Ltd., Singapore (SG)

( * ) Notice: Subject to any disclaimer, the term of this patent is extended or adjusted under 35 U.S.C. 154(b) by 123 days.

(21) Appl. No.: 12/598,491

(22) PCT Filed: Apr. 30, 2008

(86) PCT No.: PCT/SG2008/000150

§ 371 (c)(1),
(2), (4) Date: Nov. 2, 2009

(87) PCT Pub. No.: WO2008/136767

PCT Pub. Date: Nov. 13, 2008

(65) Prior Publication Data

US 2010/0117388 A1 May 13, 2010

(30) Foreign Application Priority Data

May 2, 2007 (SG) ..... 200703049-7
May 29, 2007 (SG) ..... 200703728-6

(51) Int. Cl.
*B66C 1/00* (2006.01)

(52) U.S. Cl. ..... 294/81.1; 212/326

(58) Field of Classification Search ..... 294/81.1, 294/81.53, 81.2; 212/326, 316; 254/396, 254/398, 393, 394, 395, 397
See application file for complete search history.

(56) References Cited

U.S. PATENT DOCUMENTS 5,354,112 A * 10/1994 Hara et al. ..... 294/81.41
7,690,707 B2 * 4/2010 Stinis et al. ..... 294/81.2
2005/0225104 A1 * 10/2005 Lim et al. ..... 294/81.1
2007/0296228 A1 * 12/2007 Mills et al. ..... 294/81.1

FOREIGN PATENT DOCUMENTS

WO WO 03/104132 12/2003
WO WO 2006/083230 8/2006
WO WO 2006083230 A1 * 8/2006

OTHER PUBLICATIONS

The ISR and Written Opinion from the corresponding Int'l Application No. PCT/SG08/00150 dated Aug. 28, 2008.
PCT; International Preliminary Report on Patentability dated Nov. 3, 2009 in Application No. PCT/SG2008/000150.

* cited by examiner

*Primary Examiner* — Saul Rodriguez
*Assistant Examiner* — Gabriela Puig
(74) *Attorney, Agent, or Firm* — Snell & Wilmer L.L.P.

(57) ABSTRACT

A head block assembly (105) comprising a first head block (120) having a first pair of cable engaging sheaves (130); a second head block (125) having a second pair of cable engaging sheaves (135); a separation device (140) mounted intermediate the first and second head blocks (120, 125), for effecting relative transverse movement of said head blocks; wherein the first pair of sheaves (130) are selectively disengagable from the first head block (120), and selectively engagable with the second head block (135).

25 Claims, 30 Drawing Sheets

METHOD AND APPARATUS FOR EFFECTING RELATIVE MOVEMENT OF CONTAINERS

This application is U.S. national phase filing under 35 U.S.C. §371 of PCT/SG2008/1000150 filed Apr. 30, 2008 and claims priority from Singapore Application Nos. SG 200703049-7 and SB 200703728-6 which were filed on May 2, 2007 and May 29, 2007, respectively, and are all incorporated herein by reference.

FIELD OF INVENTION

The invention relates to the manipulation of intermodal units such as containers, flat racks and other devices used for containing freight for shipping. It further relates to the engagement of intermediate lifting units such as spreaders. In particular, the invention relates to devices and methods for engaging the intermodal units, either directly or through a spreader, including engaging multiple containers at one time and shifting their relative positions.

BACKGROUND

It is well established that a key economic factor involved in the shipping of containers is the speed by which containers are loaded, unloaded and moved around a container yard. Recently inventions relating to the engagement and movement of more than one container have been suggested.

A characteristic of these multi-container devices is the problem of maintenance and the length of "downtime" of this capital intensive equipment. An example is described in WO03/104132, the contents of which are incorporated herein. If a problem arises with one of the head blocks, it is necessary to remove the entire device from the crane including disengaging the cables from the sheaves. As the separation mechanism between the head blocks uses a considerable number of actuators, this may be a significant cause of maintenance problems. If the repair or maintenance requires a workshop, the entire device must be removed from the crane by unthreading the cables. The time taken to remove and then replace the device on the crane, so as to make the crane functional, is considerable leading to significant loss of lifting capacity.

Another drawback of these types of devices is the complexity that goes into their manufacture. Typically they are large complicated devices requiring significant engineering and control over the large number of actuators involved with their operation. For instance, there are seven or more actuators required to operate the device shown in WO03/104132 (see FIG. 2). The control system or operator control needs to be complex in order to operate the device, not only for separation of the containers attached to the head blocks, but also to change their relative position, such as by "skewing" the containers, which requires operation of one set of actuators only.

It would, therefore, be advantageous to have a device which may improve the maintenance issues of said devices.

STATEMENT OF INVENTION

In a first aspect the invention provides a head block assembly comprising a first head block having a first pair of cable engaging sheaves; a second head block having a second pair of cable engaging sheaves; a separation device mounted intermediate the first and second head blocks, for effecting relative transverse movement of said head blocks; wherein the first pair of sheaves are selectively disengagable from the first head block, and selectively engagable with the second head block.

In a second aspect the invention provides a method comprising the steps of: providing a first and second head block engaged in a side by side arrangement; releasing a second sheave mounted to the second head block; retracting an actuator mounted between the first head block and the second sheave, and so sliding the second sheave from the second head block toward the first head block; coupling the second sheave to a first sheave mounted to the first head block; releasing the first sheave from the first head block; extending the actuator, and so sliding the coupled sheaves from the first head block to the second head block, and disengaging the actuator from the second sheaves, and so disengaging the first head block from the second head block.

In a third aspect, the invention provides a method of converting a dual spreader engagement device to a single spreader engagement device comprising the steps of: providing a first and second head block, each adapted for engaging a single spreader, said head blocks engaged in a side by side arrangement; releasing a second sheave mounted to the second head block; retracting an actuator mounted between the first head block and the second sheave, and so sliding the second sheave from the second head block toward the first head block; coupling the second sheave to a first sheave mounted to the first head block; releasing the first sheave from the first head block; extending the actuator, and so sliding the coupled sheaves from the first head block to the second head block, and disengaging the actuator from the second sheaves, and so disengaging the first head block from the second head block, and; mounting the coupled sheaves to the second head block such that the second head block is operable as a single spreader engagement device.

Therefore, the invention provides for the sheaves of a first head block to be transferred to a second, and so releasing the first head block for maintenance. Similarly, it may be possible to remove the sheave pins of all the sheaves, and so detaching both head blocks permitting replacement head blocks to be attached to the sheaves or alternatively a single head block attached to both sheaves for continued used of the crane. In any event, it is not necessary for cables to be removed from the sheaves in order to maintain the crane in useful operation whilst maintenance is carried out.

In a preferred embodiment, the separation device may be disengageable from the second head block such that the first head block retains the separation device. Accordingly the first head block and the separation device could both be sent to the workshop for maintenance without disengaging the cables from the sheaves and so maintaining the crane in operation.

In a preferred embodiment, the hydraulic systems, actuators and linkages associated with the separation device may also be mounted on the first head block. In this case the remaining portion of the assembly may be the second head block and sheaves associated with both head blocks. Being substantially heavy machinery, the frequency for maintenance is much less as compared to the separation device. Accordingly that portion of the total assembly that requires maintenance more frequently is that which is more easily detachable from the crane.

In a fourth aspect the invention provides a method for engaging a first and second head block, the method comprising the steps of: providing a first and second head block engaged in a side by side arrangement; biasing mutually coupled first and second sheaves from a first position on the second head block to a second position on the second head block; uncoupling the sheaves; engaging the second sheave to the second head block; biasing the first sheave to a third position on the first head block; and engaging the first sheave to the first head block at the third position.

In a fifth aspect, the invention provides a method of engaging a first and second head block, the method comprising the steps of providing the first and second head blocks in a side by side arrangement; releasing a first sheave mounted to the second head block, said first sheave coupled to a second sheave; extending an actuator mounted between the second head block and the first sheave, and so sliding the first and second sheaves from the second head block toward the first head block; releasing the second sheave from the first sheave and engaging the second sheave to the second head block; extending the actuator, and so sliding the first sheave from the second head block to the first head block; engaging the first sheave with the first head block; and disengaging the actuator from the first sheave and so engaging the first head block to the second head block.

In a sixth aspect the invention provides a method for disengaging a first and second head block, the method comprising the steps of: providing a first and second head block engaged in a side by side arrangement; releasing a first sheave mounted to the first head block; retracting an actuator mounted between the second head block and the first sheave, and so sliding the first sheave from the first head block toward the second head block; coupling the first sheave to a second sheave mounted to the second head block; releasing the second sheave from the second head block; retracting the actuator, and so sliding the coupled sheaves to a retracted position on the second head block, and so disengaging the first head block from the second head block.

BRIEF DESCRIPTION OF DRAWINGS

It will be convenient to further describe the present invention with respect to the accompanying drawings that illustrate possible arrangements of the invention. Other arrangements of the invention are possible and consequently the particularity of the accompanying drawings is not to be understood as superseding the generality of the preceding description of the invention.

DESCRIPTION OF PREFERRED EMBODIMENT

Figure 1A:
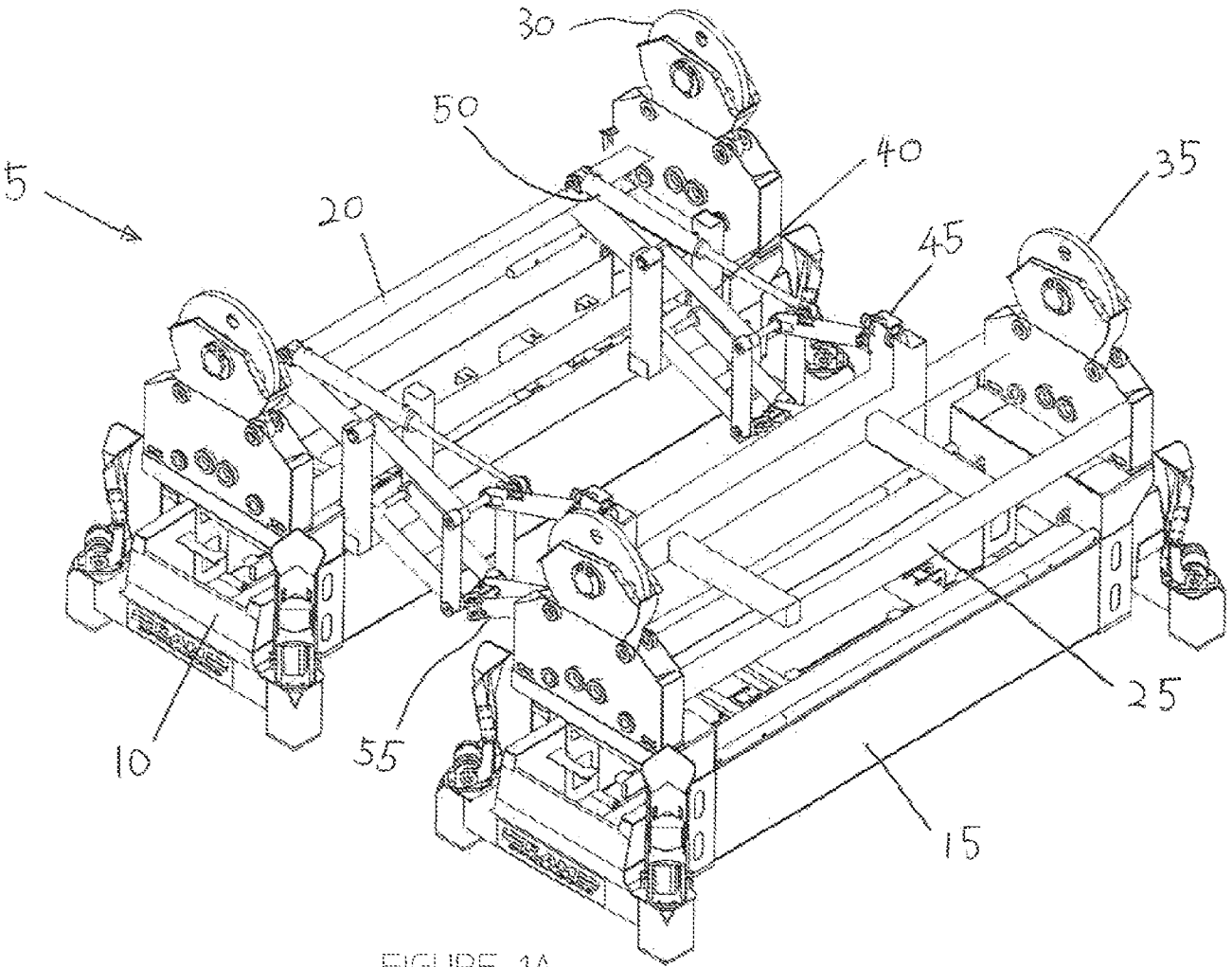
FIG. 1A is an isometric view of the engagement device according to a first embodiment of the present invention.
Figure 1B:
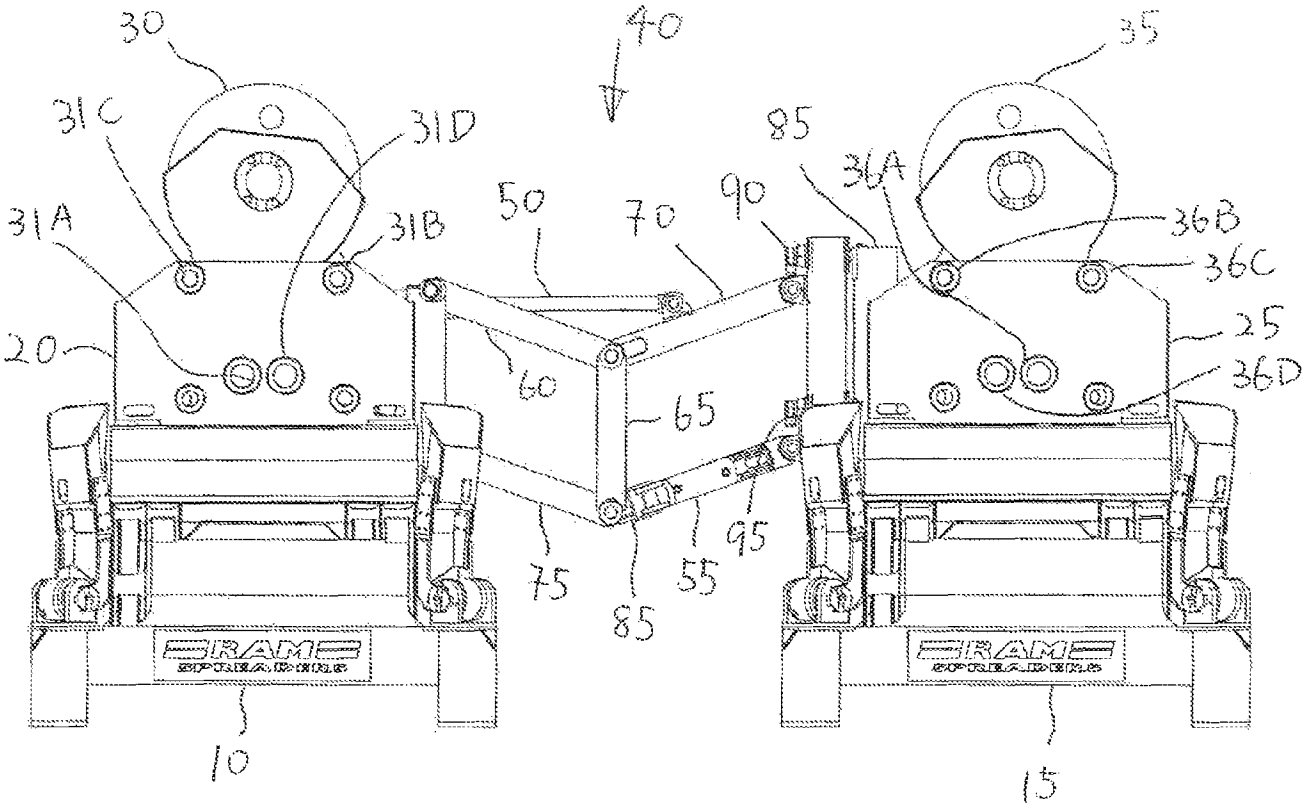
FIG. 1B is a side elevation view of the engagement device of FIG. 1A.

FIGS. 1A and 1B show the engagement device 5 according to a first embodiment of the present invention. Here the device has engaged two spreaders 10, 15 beneath respective coupled head blocks 20, 25. The head blocks 20, 25 are coupled through a separation device 40 mounted between the head blocks 20, 25. Specifically, the separation device 40 is mounted to a first head block 20 which is extended out so as to engage with the second head block 25 through twist locks 90, 95. The twist locks 90, 95 are engaged with a bracket 85 mounted on the second head block 25 so as to make the releasable connection between the head blocks 20, 25.

In this embodiment, the head blocks 20, 25 have attached thereto a pair of sheaves 30, 35 with one sheave at either end of each head block, making it a total of four. Each head block 20, 25 includes four sheave pin locations 31A to D, 36A to D. Whilst engagement of one sheave requires only two such locations, by providing four, the each head block is capable of acting as the main head block or the detachable head block. It will be noted that the upper sheave pin locations are smaller than the corresponding lower locations. It is intended that the main load bearing pins be located in the lower portion, hence the difference in size. Further, and as will be explained in further detail later, each lower sheave pin must be capable of supporting the load of the cables through the corresponding sheave. This is because, in the single spreader orientation, the upper sheave pin will be engaged with the adjacent sheave, and so no longer supporting the load.

The first head block 20 includes the sheave 30 which is mounted to the head block 20 through sheave pins 31A, 31B. In this orientation the sheave pins 31A, 31B are sufficient to transmit the load through sheave from the head block which is supporting the spreader 10 through to the sheave 30 and subsequently to the crane (not shown). The sheave pins 31A, 31B are releasable such that the sheave 30 can be removed from the head block 20 under specific circumstances. As will be described later this is a key embodiment of the present invention.

Similarly the second head block 25 also has a sheave 35 mounted thereto through sheave pins 36A, 36B. Again the sheave pins 36A, 36B are selectively releasable so as to disengage the sheave 35 from the head block 25 at the appropriate time.

The separation device 40 comprises a parallelogram structure comprising vertical member 65 separating upper linkages 60, 70 and lower linkages 75, 80. In the connected arrangement i.e. with twist locks 90, 95 mounting the separation device 40 to the second head block 25, operation of the separation device 40 will effect relative transverse movement of the head blocks 20, 25.

Figure 2A:
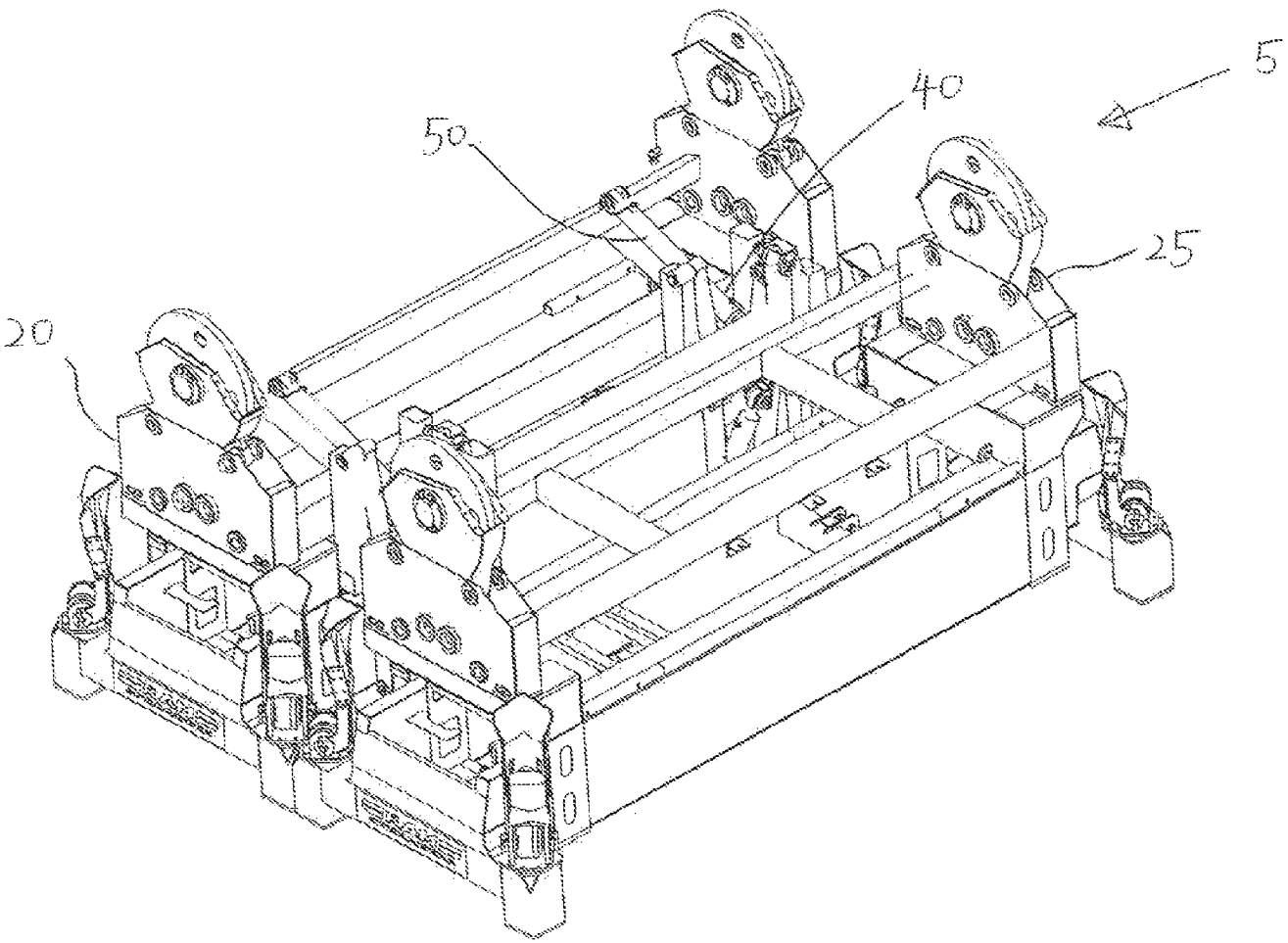
FIG. 2A is an isometric view of the device of FIG. 1 in the retracted position.
Figure 2B:
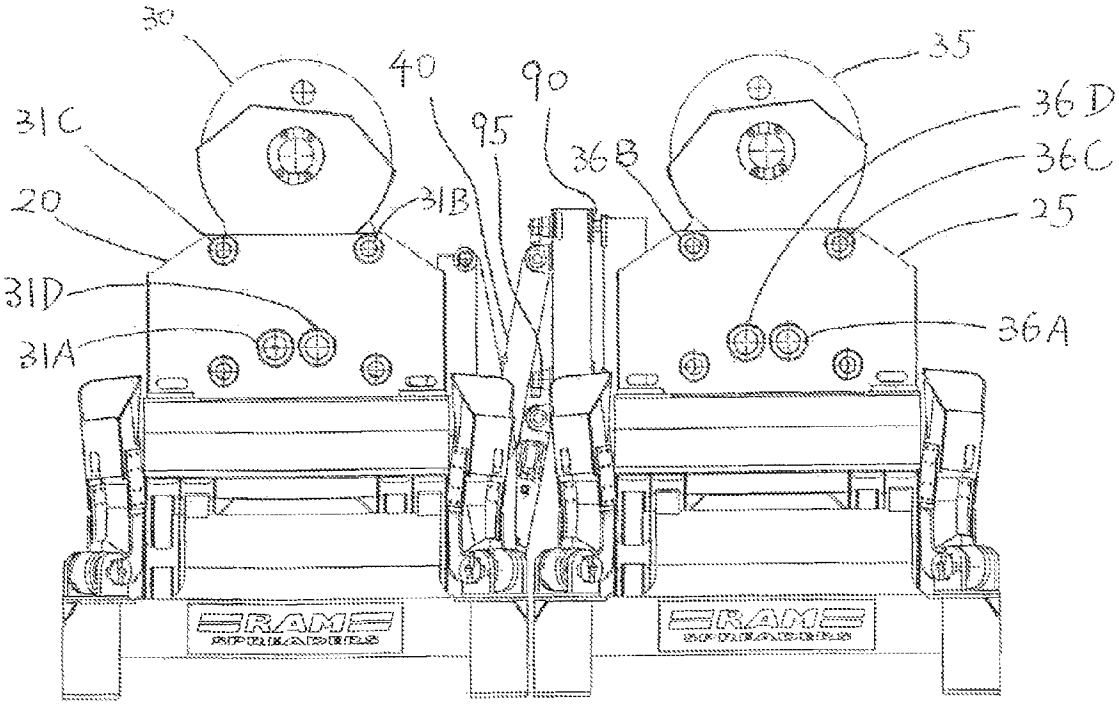
FIG. 2B is a side elevation view of the device of FIG. 2A.
Figure 3:
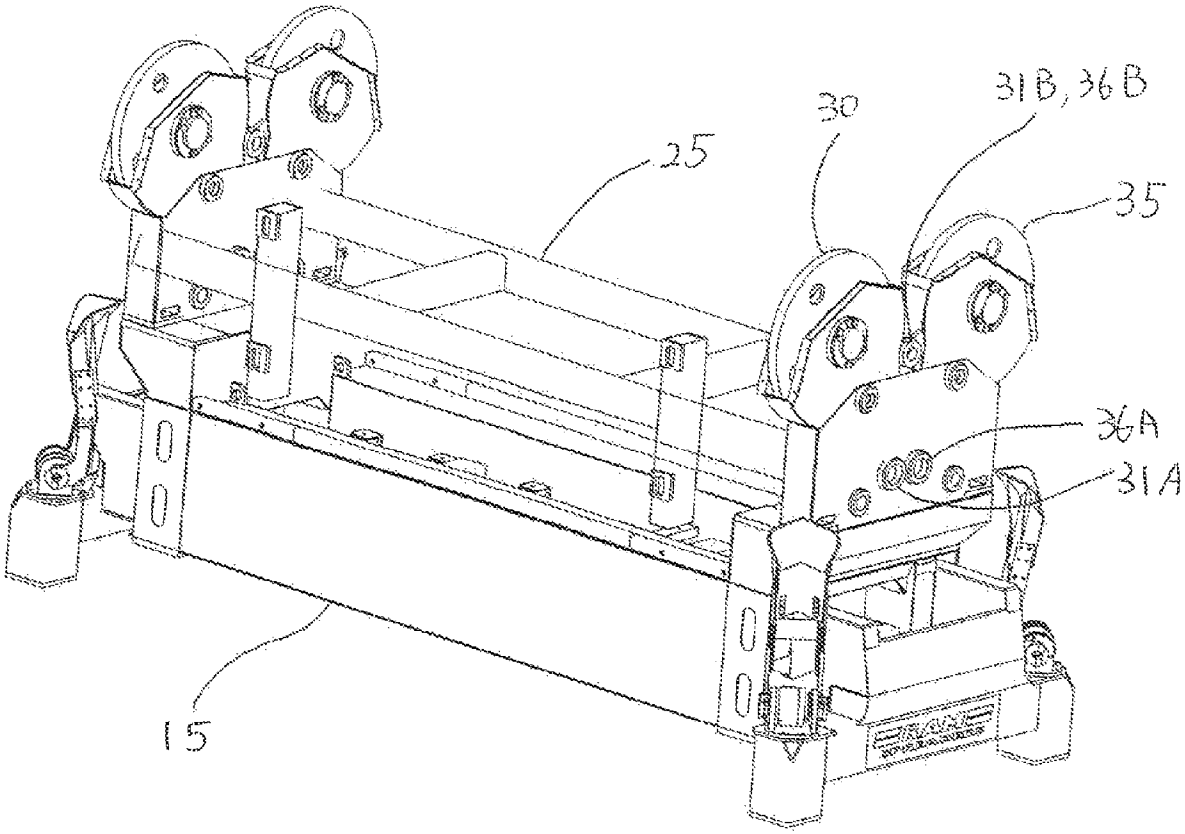
FIG. 3 is an isometric view of the retained head block of the device of FIG. 1A.
Figure 4:
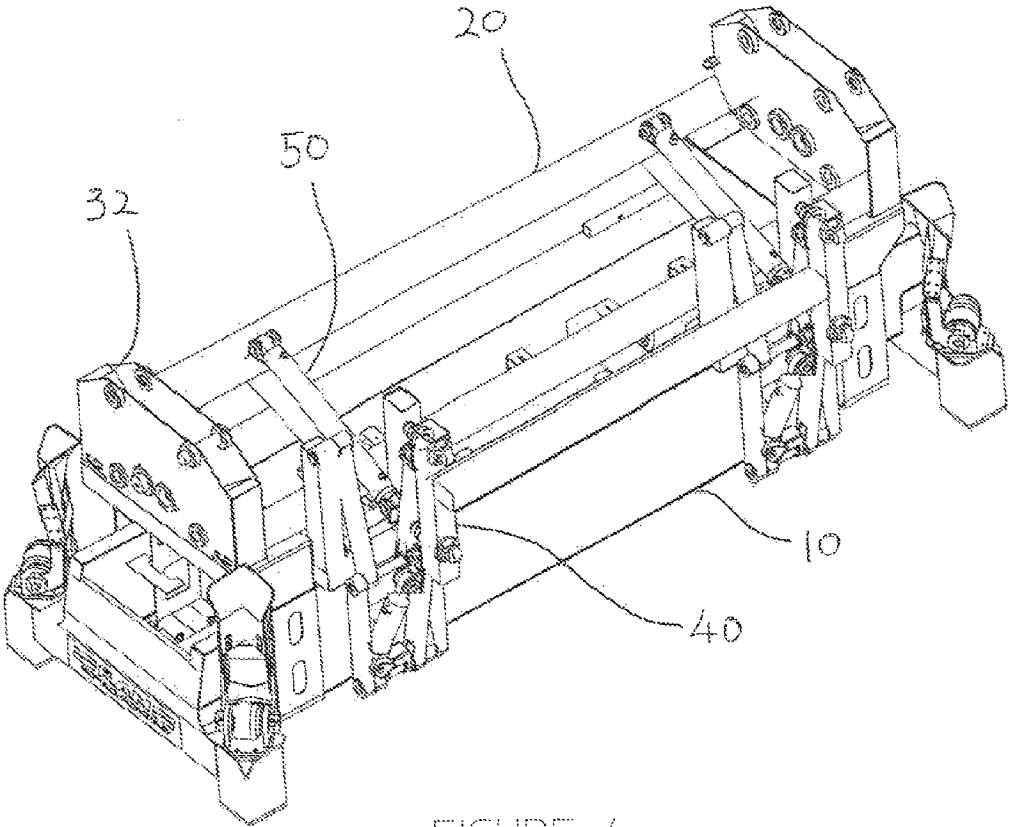
FIG. 4 is an isometric view of the detached head block of the device of FIG. 1A.
Figure 5:
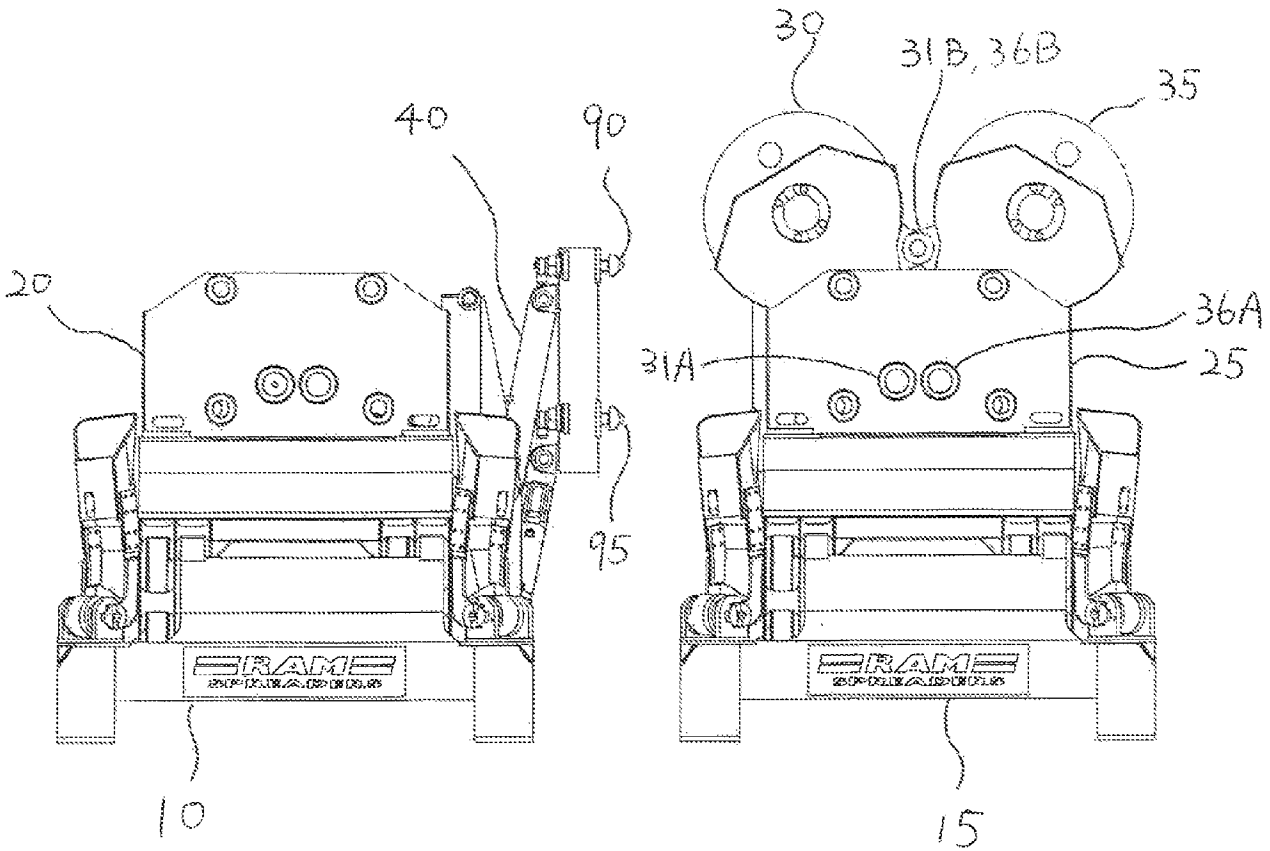
FIG. 5 is a side elevation view of the device in the detached arrangement; according to the first embodiment.

This transverse movement can be more clearly seen in FIGS. 2A and 2B whereby the separation device 40 has moved to a retracted position such that the head blocks 20, 25 are now proximate to each other from the extended position shown in FIGS. 1A and 1B. It will be seen that the separation device 40 has retracted so as to fold downwards within the space defined by the head blocks 20, 25. It should be noted that operation of the separation device occurs through extension or retraction of a linear actuator 50 mounted between the first head block 20 and the separation device such that on retraction of the actuator 50, the separation device is folded so as to draw the second head block 25 towards the first head block 20. FIGS. 3 and 4 show the end result of the invention whereby the sheave 30 can be removed from the first head block 20 by disengaging the sheave pins 31A, 31B. The disengaged sheave 30 is then mounted to the second head block as shown in FIG. 5. The two sheaves 30, 35 are mounted together at sheave pin locations 31B, 36B and then each separately to the to the second head block 25 directly through sheave pins 31A and 36A respectively. In this orientation, whilst the sheaves may now be inclined as compared to their original orientation, there is still sufficient clearance for them to function together so as to engage cables from the crane (not shown). By mounting the two sheaves 30, 35 together, the second head block 25 becomes indistinguishable from a single spreader head block and functions accordingly. This is achieved without having to disengage cables and so allows use of the crane after a short transition time whilst the sheaves are remounted.

Further the first head block 20 can now be taken to the workshop for maintenance as it is now fully disengaged from the crane. The separation device 40 having three actuators 50, 55 and several moving parts is more prone to require maintenance and, therefore, is mounted to the first head block. It should be noted that should maintenance be required for the second head block 25, the sheaves 30, 35 can be disengaged and reengaged with a similar head block (not shown) and thus engagement and disengagement of the second head block is also possible without the need for the crane to be taken offline subject to the availability of a suitable head block.

Figure 6A:
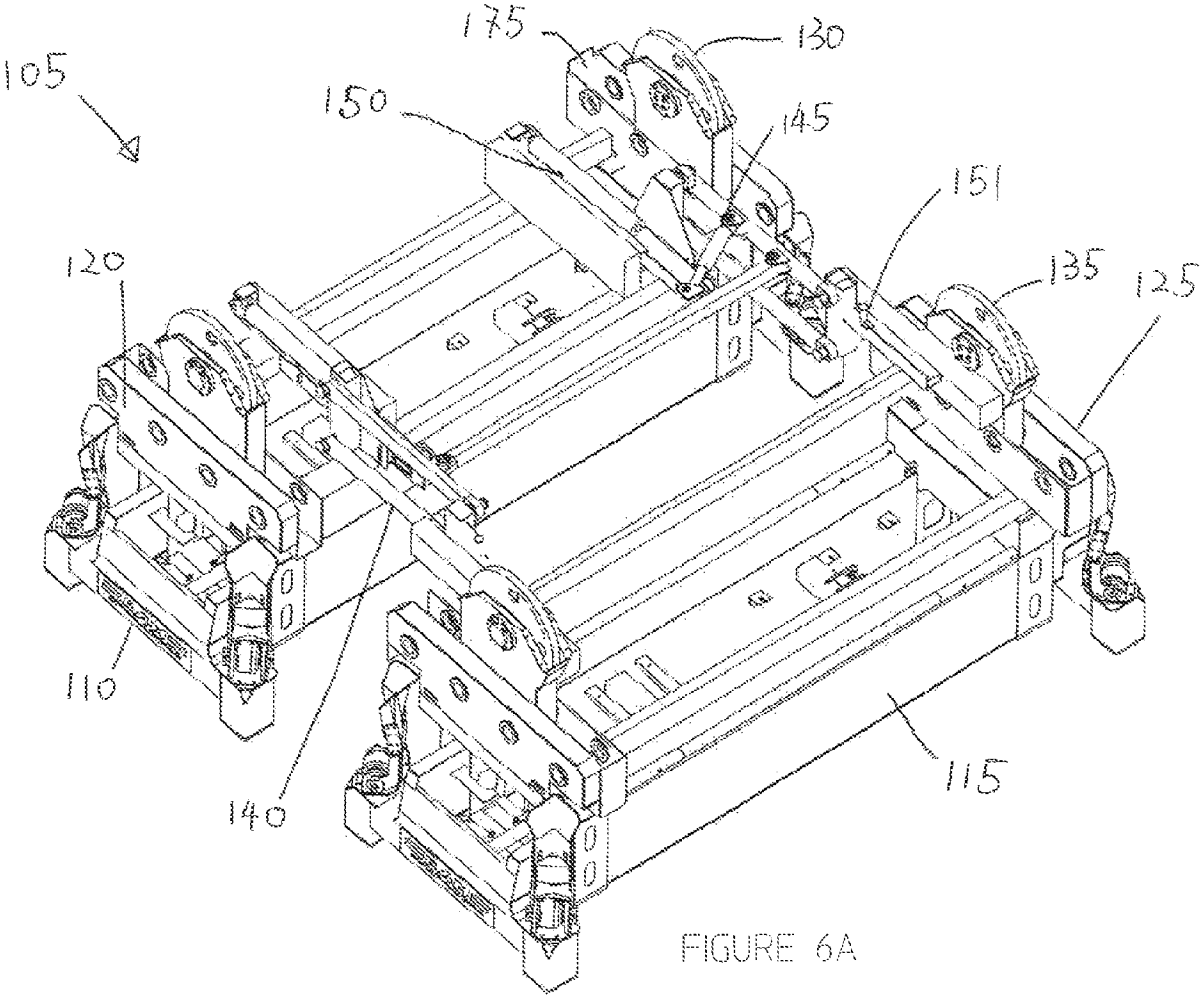
FIG. 6A is an isometric view of a second embodiment of the engagement device according to the present invention.
Figure 6B:
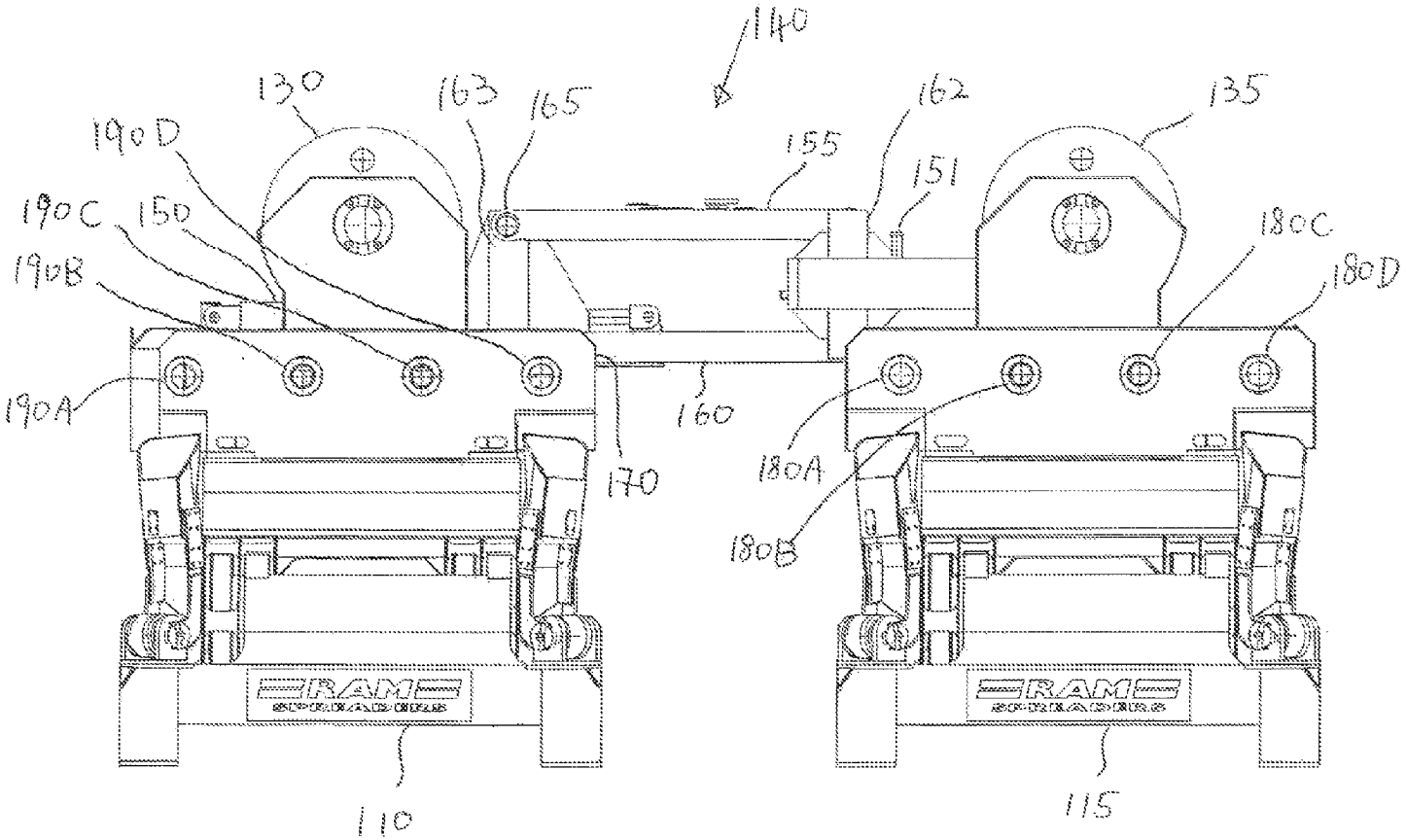
FIG. 6B is a side elevation view of the device of FIG. 6A.

FIG. 6A and 6B show a second embodiment falling within the scope of the present invention. Here, two head blocks 120, 125 are again mounted to spreaders 110, 115. The head blocks 120, 125 are connected through a separation device 140 which effects relative transverse movement between the head blocks 120, 125. As with the previous embodiment each head block includes a pair of sheaves 130, 135 for engagement with cables coming from a crane (not shown).

The separation device 140 separates the head blocks 120, 125 through extension and retraction of actuator 150 mounted to the separation device 140. This embodiment varies from the first embodiment in that the separation device 140 is mounted between the first head block 120 and the second sheave 135, rather than directly to the second head block 130 as is the case for the first embodiment. The advantage of this variation in mounting will become apparent as the function of the engagement device 105 is further described.

Considering the first head block 120, the sheave 130 is mounted to the head block 120 through central sheave pins 190B, 190C. Further the head block 120 includes additional sheave pin locations 190A, 190D on either side of the central sheave pins 190B, 190C which permit variation in positioning of the head block. Thus with the head block 120 having a single sheave 130, the sheave 130 is positioned at the central sheave pin locations 190B, 190C so as to centrally place the sheave.

The second head block 125 includes a sheave 135 also positioned on sheave pin locations 180B, 180C which are also centrally located. As with the first head block 120, the second head block 125 includes additional sheave pin locations 180A, 180D on either side of the central sheave pins 180B, 180C so that collectively the sheave pin locations 180A to D allow for the positioning of two sheaves side by side on the same head block.

The separation device 140 comprises a single parallelogram having an upper member 155 and lower member 160 separated by vertical members 162, 163. The parallelogram functions through pin joints between the members such that vertical relative displacement of the head blocks 120, 125 is achieved through applying a force to one of said containers which yields a deformation of the parallelogram. For instance, there may be a differential in height of the head blocks when the device 5 seeks to engage two containers of different height, such as a 8.5 ft container and a 9.5 ft container. The parallelogram structure also ensures both head blocks are either level or have the same inclinations to the ground at all time. For example, when one head block engages a 9.5 ft container which is placed on flat ground, the parallelogram structure will keep the other head block level to the ground as it continues to lower on to an 8.5 ft containers.

As mentioned previously the transverse movement is controlled by an actuator 150 which is mounted between the first head block 120 and the separation device 140.

Thus, transverse movement of the head blocks is achieved through applying a force to the separation device 140 which is transmitted through the sheave pin mounting of the second sheave 135 to the second head block 125. The separation device 140 is selectively disengagable from the second sheave 135 through removal of a connection pin 151 so that on disengagement from the second sheave, the separation device 140 can retract back to the first head block 120.

Figure 7A:
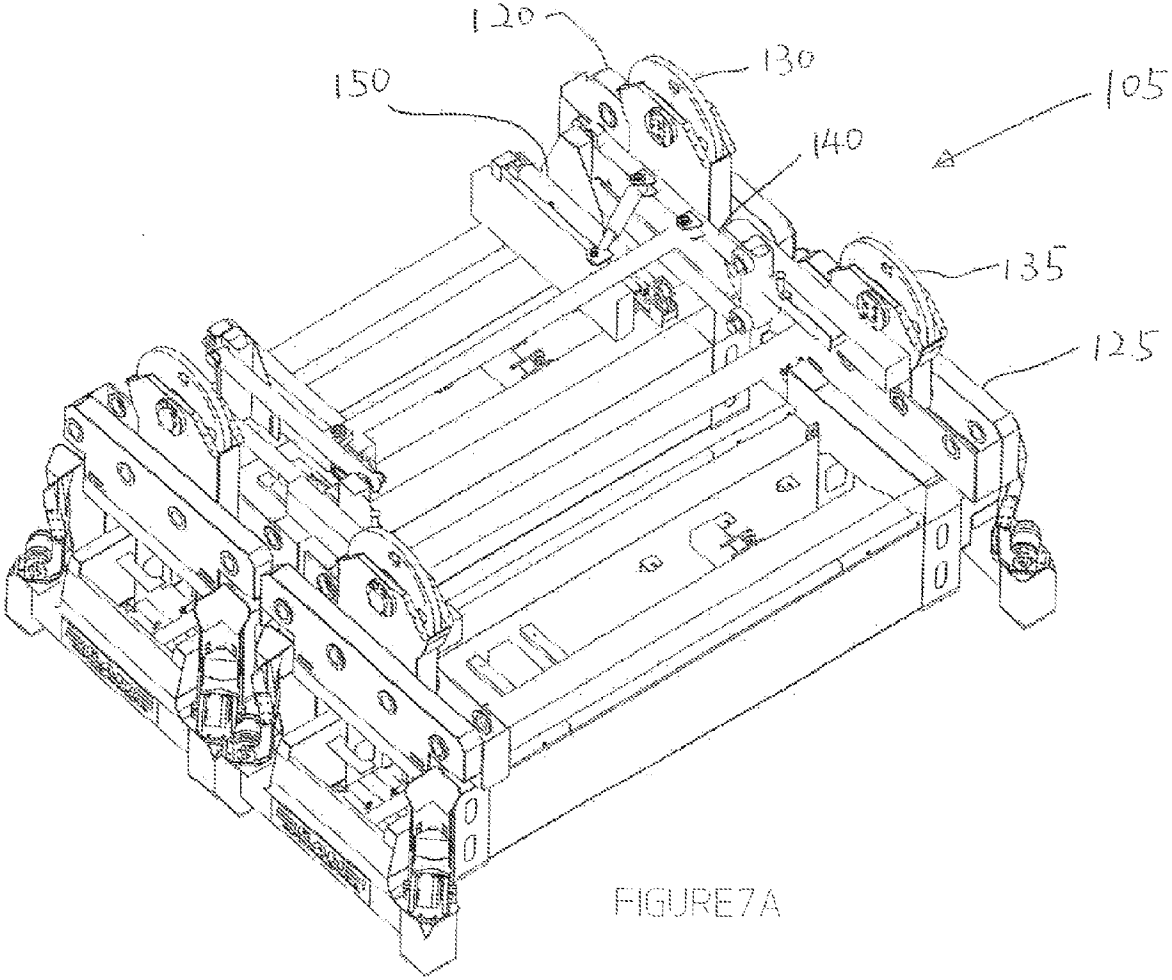
FIG. 7A is an isometric view of the device of FIG. 6A in the retracted position.
Figure 7B:
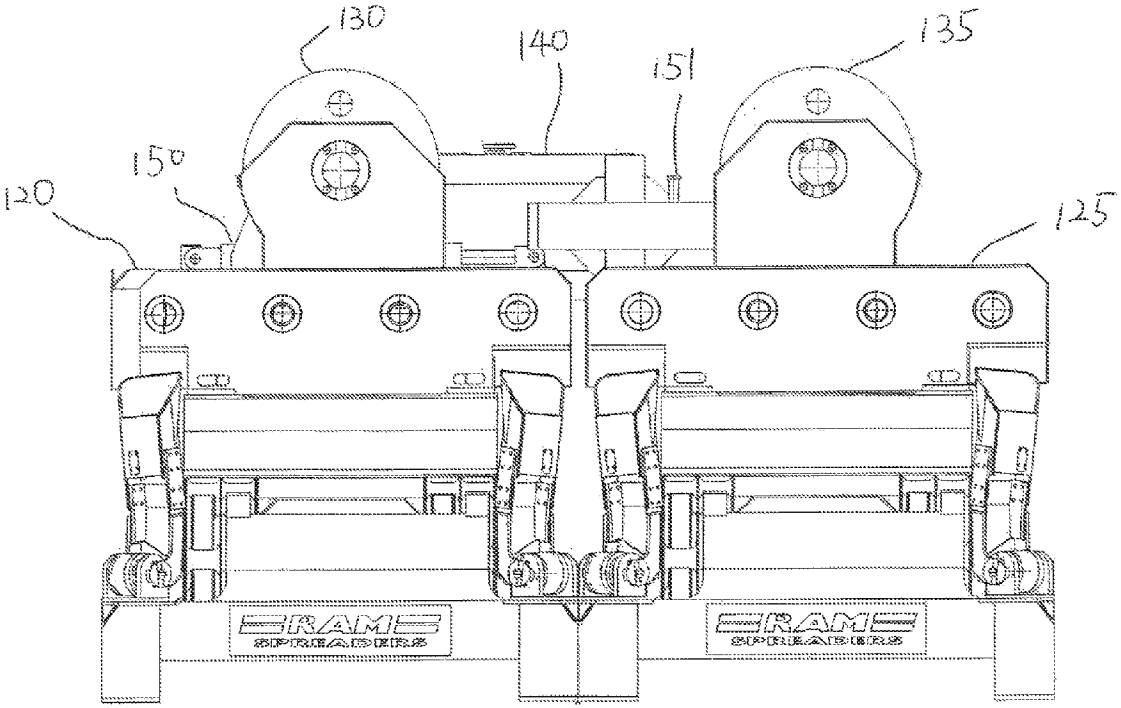
FIG. 7B is a side elevation view of the device of FIG. 7A.
Figure 7C:
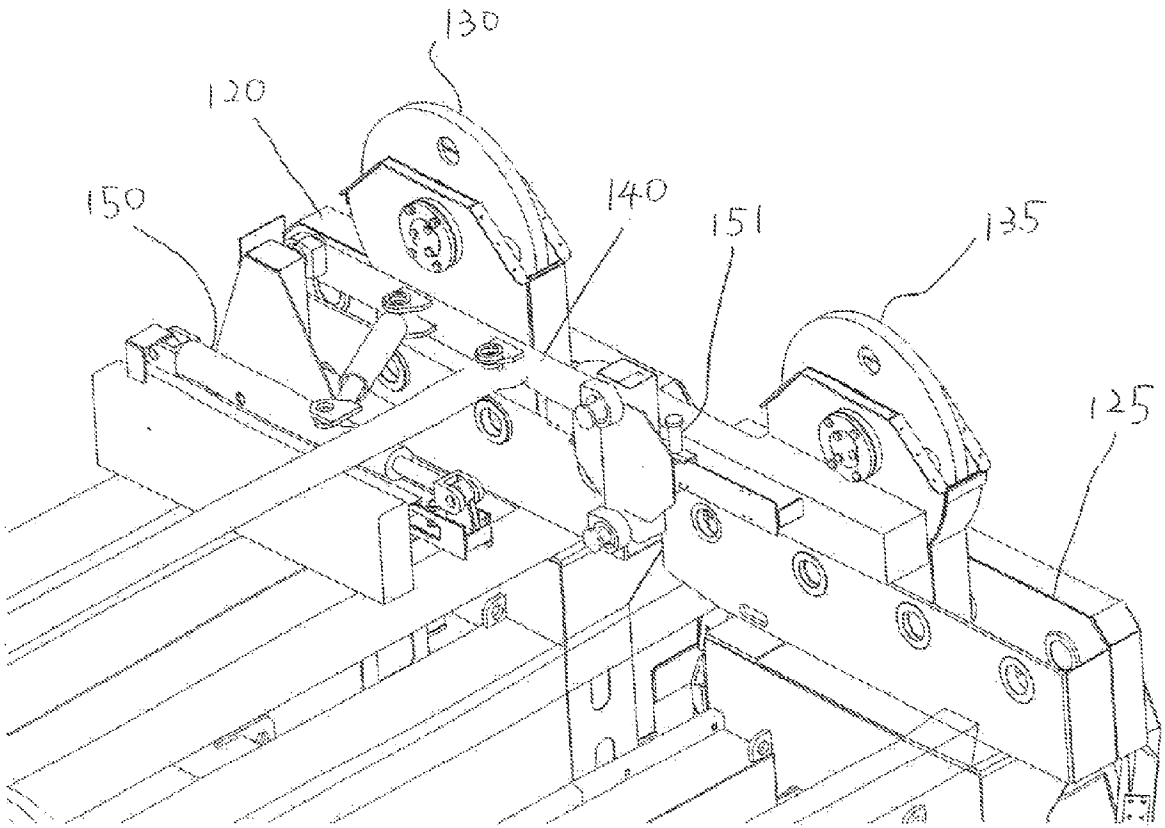
FIG. 7C is a detailed isometric view of the device of FIG. 7A.

FIGS. 7A and 7B show the retracted position of the head blocks 120, 125 on retraction of the actuator 150. It is in this position that the detachment process can take place which is the subject of the present invention and further described in FIGS. 8A to 8D.

Figure 8A:
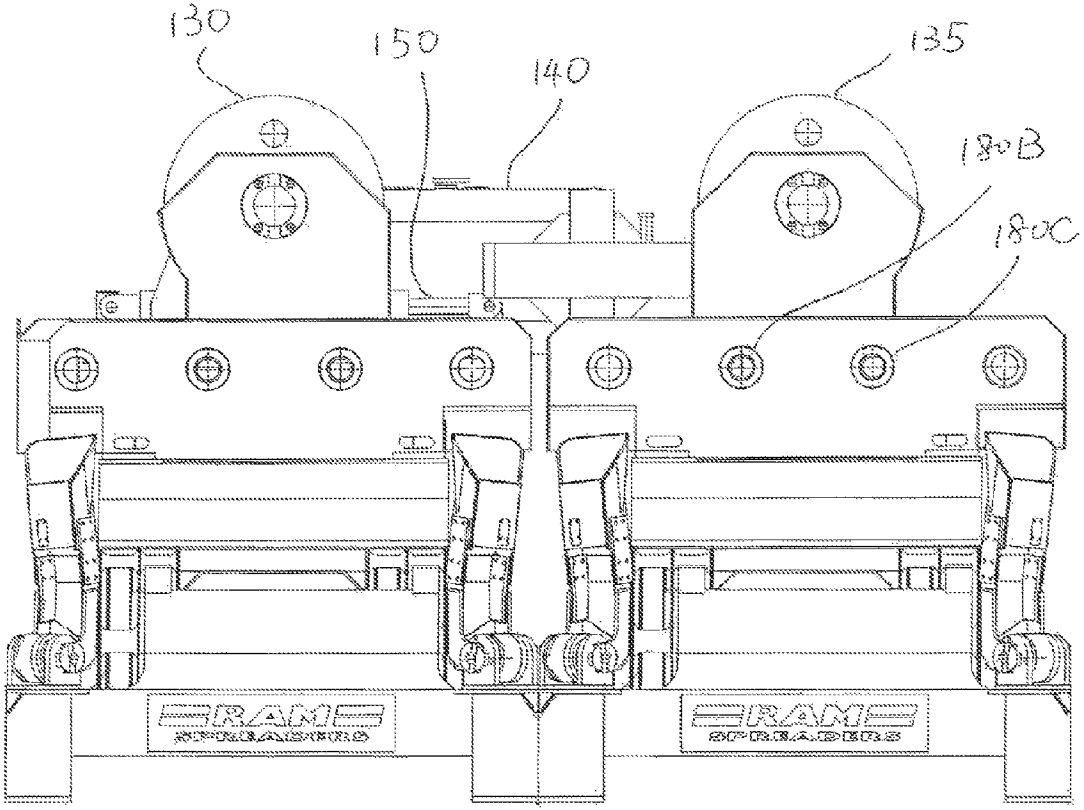
FIGS. 8A to 8D are sequential elevation views of the detachment process according to a third embodiment of the present invention.
Figure 8B:
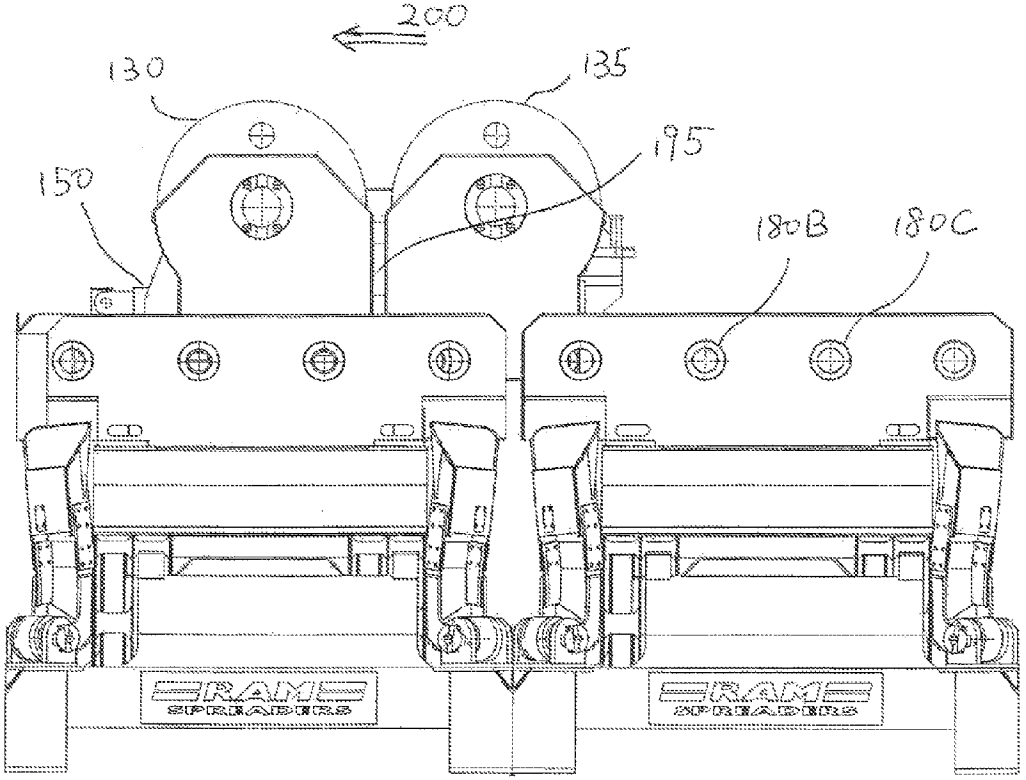
Figure 8C:
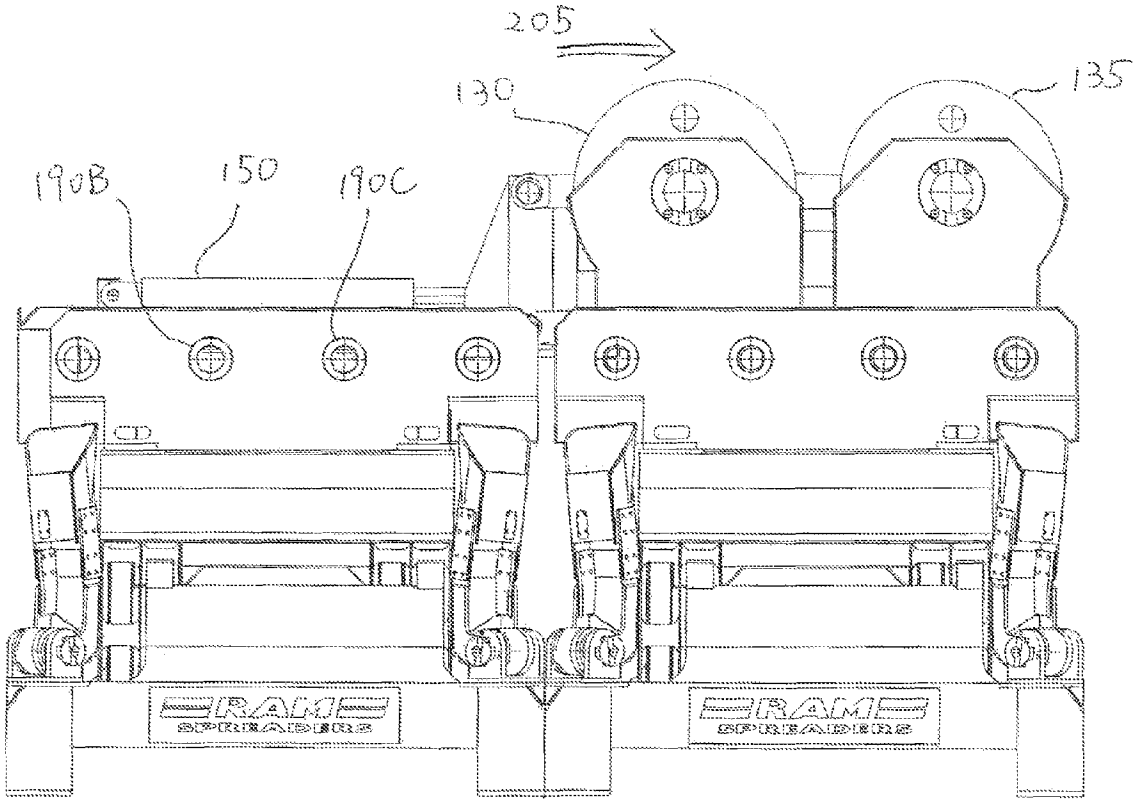

FIG. 8A is similar to FIG. 7B in that the head blocks 120, 125 are in the retracted position such that they are proximate to each other, ready for commencement of the detachment process. FIG. 8B. shows the effect of firstly disengaging the second sheave 135 through removal of the sheave pins 180B, 180C. On removal of the sheave pins the actuator 150 retracts. Without the sheave pins 180B, 180C, instead of applying the retraction force to the second head block 125, instead it draws 200 the second sheave 135 towards the first sheave 130 so as to bring them into close proximity. The second step involves coupling the sheaves 130, 135 through a connection pin 195 such that they are effectively joined, ready for transfer to the second head block 125.

The next step involves removing the sheave pins 190B, 190C from the first sheave 130 so as to disconnect it from the first head block 120. On removal of the sheave pins, the actuator 150 is extended and again, with the removal of the sheave pins, the impediment is removed and so the coupled sheaves 130, 135 are shifted 205 to the second head block 125 so as to align with the sheave pin locations of the second head block 180A to D.

Figure 8D:
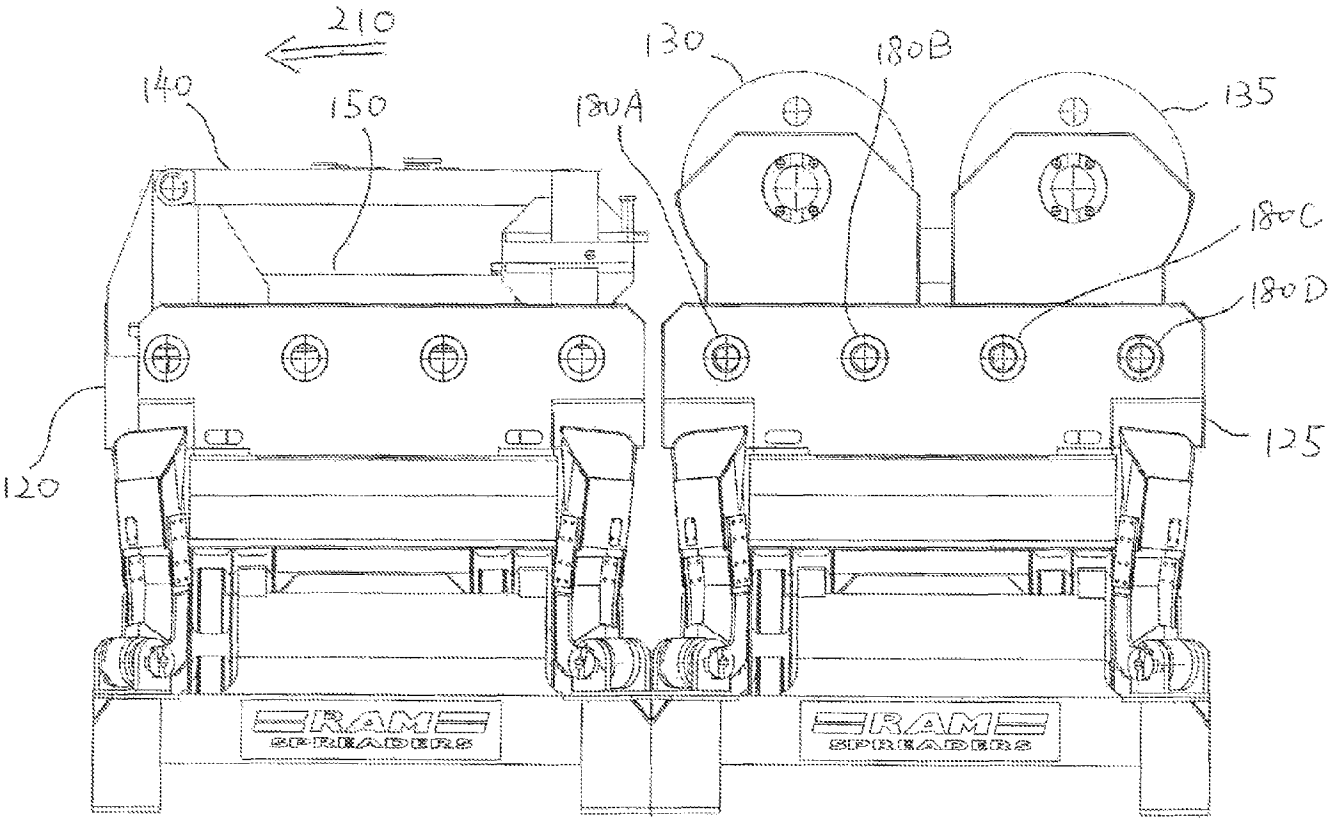

The final step, as shown in FIG. 8D, involves engaging the sheaves 130, 135 with the second head block at sheave pin locations 180A to D such that the second head block 125 is now fully engaged with the sheaves 130, 135. The connection pin 151 mounting the separation device 140 to the sheaves 130, 135 is then removed, allowing the actuator 150 to retract back to the first head block 120. On removal of the connection pin 151, the first head block 120 is effectively detached from the second head block and so may be removed to a workshop for maintenance. Given the actuators and moving parts of the separation device, it is likely that maintenance work will be more frequently required for the separation device 140 and it is therefore appropriate that it is mounted to the first head block for removal from the crane (not shown) with relative ease. The second head block 125 now has sheaves 130, 135 mounted to it and so is, for all intents and purposes, now a single spreader head block working independently from the first head block.

As with the first embodiment, the second embodiment also provides for the second head block 125 to be detached from the crane for removal of the sheave pins 180A to D should this be necessary. Thus, should maintenance of the second head block be required, a replacement head block can be provided and mounted to the sheaves 130, 135 after detaching the second head block 125.

Figure 9:
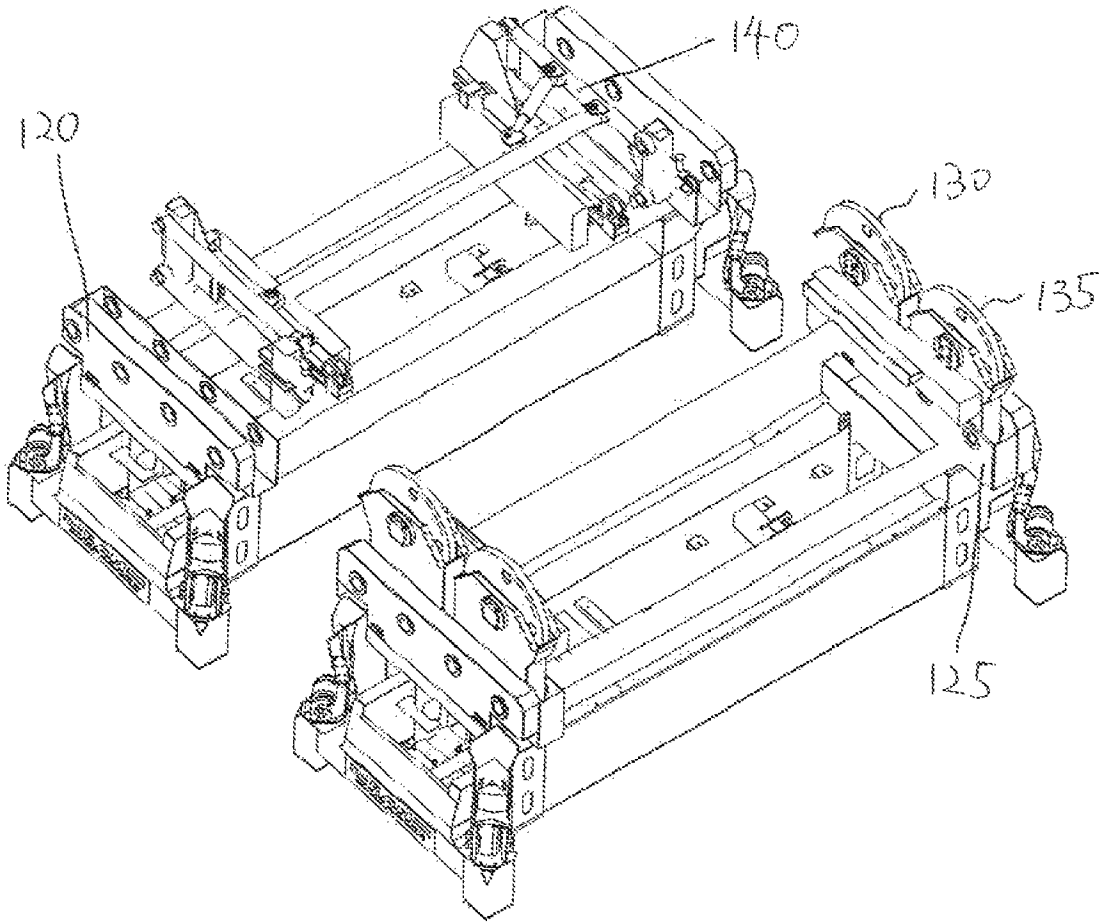
FIG. 9 is an isometric view of the device in the detached arrangement according to the second embodiment.

FIG. 9 shows the end result of the detachment having the first head block 120 isolated from the second head block 125 through detachment of the sheaves 130, 135.

Figure 10:
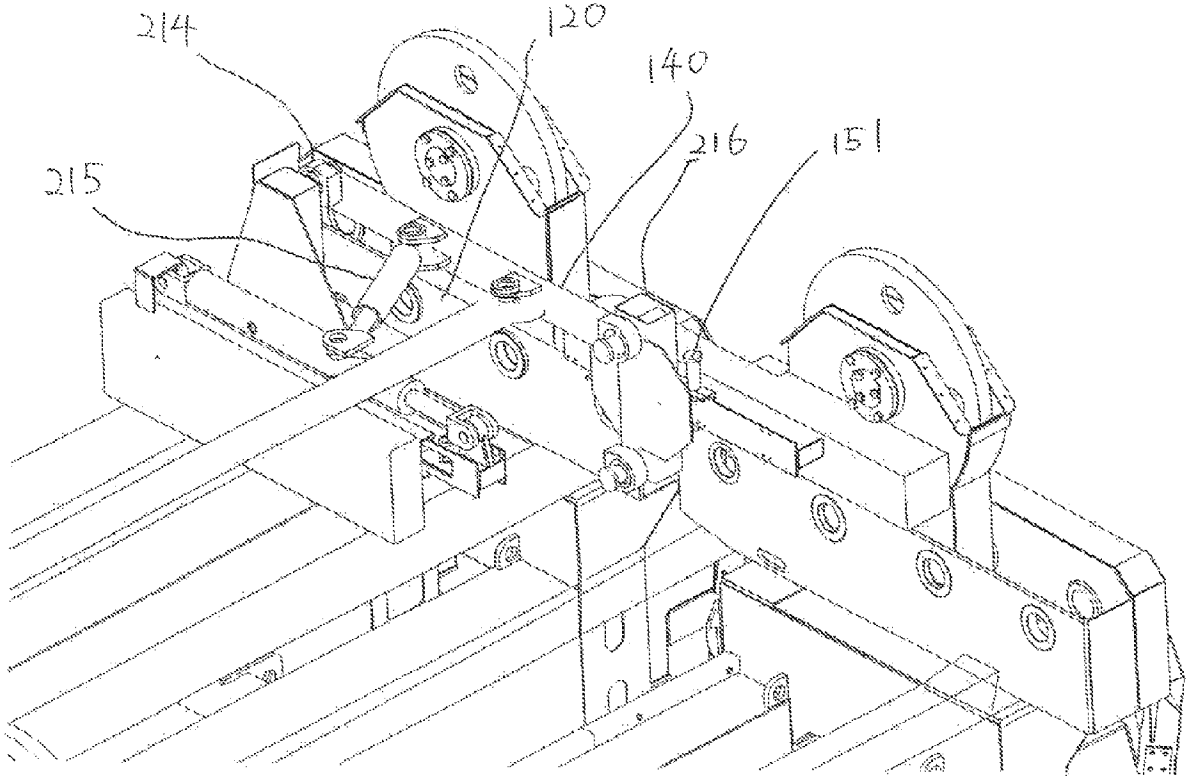
FIG. 10 is a detailed isometric view of the device of FIG. 6A.
Figure 11:
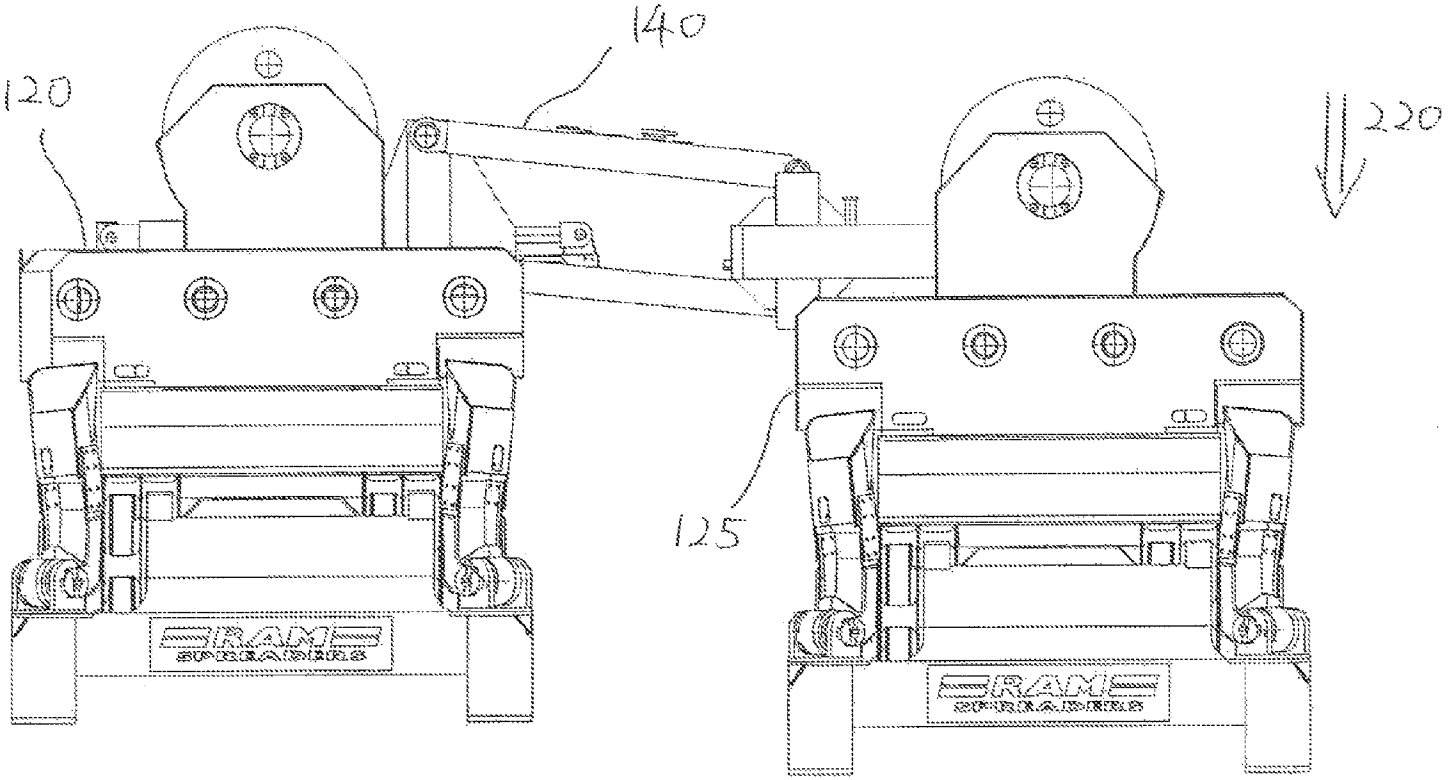
FIG. 11 is a side elevation view of the device of FIG. 6A demonstrating vertical float.

FIGS. 10 and 11 show further functionality of the engagement device whereby an offset actuator 215 is provided between the first head block 120 and the separation device 140. On activation of the off set actuator 215, relative longitudinal movement of the head blocks 120, 125 can be effected through ball joint connections 214, 216 of the separation device 140 thus permitting the relative longitudinal movement.

FIG. 11 shows further functionality of the engagement device whereby deformation of the separation device 140 through activation of the vertical float actuator permits relative vertical movement 220 of the head blocks 120, 125.

Figure 12:
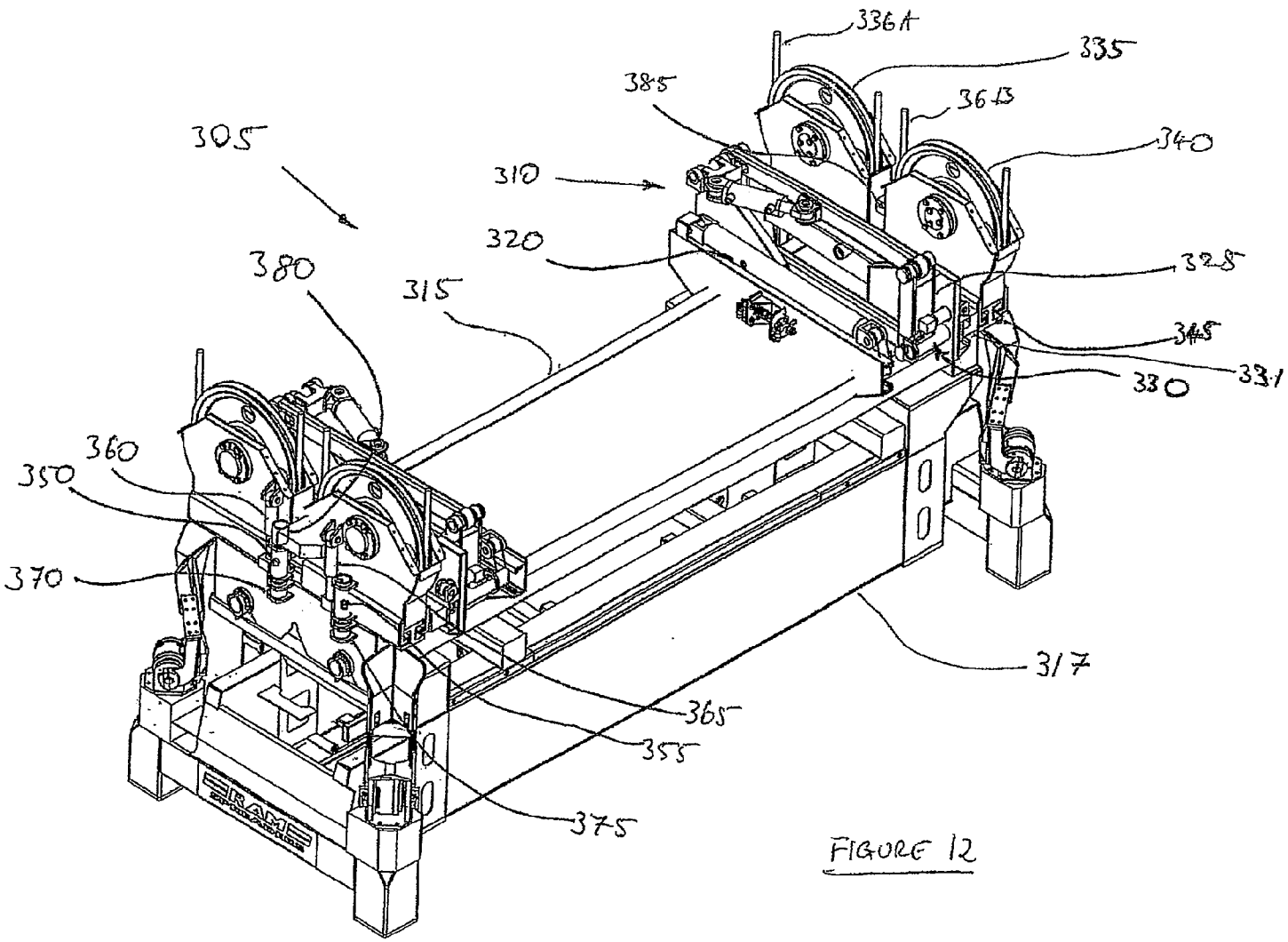
FIG. 12 is an isometric view of a further embodiment of the present invention whilst in the single spreader arrangement.

In particular FIG. 12 shows the single head block arrangement wherein the head block assembly 305 has a head block 315 to which is attached two pairs of sheaves 335, 340, in that both are mounted to a rail 345 which is in turn attached to the head block 315. The rail 345 permits sliding of the sheaves 335, 340 when said sheaves are detached from the head block.

In this arrangement the first pair of sheaves 340 is releasably fixed to the head block 315 through a pin 355 engaged with a recess 375. Engagement and disengagement of the pin 355 is achieved through an actuator 365 mounted between the sheave 340 and the pin 355. Thus by activating the actuator 365, the pin 355 is pushed downwards so as to engage with the recess 375 and thus fix the first sheave 340 so as to prevent sliding along the rail 345.

Also mounted to the head block 315 is a second pair of sheaves 335 having a similar pin 350 for engaging with a recess 370 which is moved through an actuator 360 to move the pin up and down so as to disengage or engage with the recess 370. Similarly with the pin 350 engaged with the recess 370, the second pair of sheaves 335 is fixed on the rail 345 and so prevented from sliding.

The sheaves 335, 340 are engaged with the head block 315 via the rail which in this embodiment is an "I" beam, whereby the sheaves are engaged with the rail 345 through a bracket which engages the upper flange of the "I" beam. By operating the cables 336A, 336B, load is transmitted through the sheaves 335, 340 to the head block 315 via engagement with the rail 345.

The separating device 310 is operable to move the first pair of sheaves 340 on to another head block (not shown). When suitably engaged with the other head block, the separating device 310 can then be used to effect relative movement between the head blocks by operation of the separating device 310.

The separating device 310 includes a linear actuator 320 which biases an arm 325 to push said arm 325 outwards. In the single head block arrangement, the separating device 310 is mounted directly to the first sheave 340 via a pin 330 which pushes horizontally into a recess 331 within the first sheave 340 for engagement and selectively disengages through withdrawing said pin 330. A further actuator is provided for the engagement and disengagement and so automating the process.

Further in this arrangement, the first and second sheaves 340, 335 are mounted together through the engagement pin 350 used to fix the second sheave 335 in place. The pin 350 is movable between two positions subject to the arrangement of the head block assembly 305. In the current single spreader arrangement, the pin 350 is located downwards so as to engage the head block recess 370, thus fixing the first sheave to both the head block 315. As will be described later, when the sheaves are moved together, the pin 350 will be raised so as to disengage from the head block recess 370 and engage the first sheave recess 380 permitting sliding of both sheaves at the same time. On reaching a predetermined position, the pin 350 is moved back to the downward position such that it disengages from the first sheave recess 380 and engages with the second head block recess 375.

Figure 13:
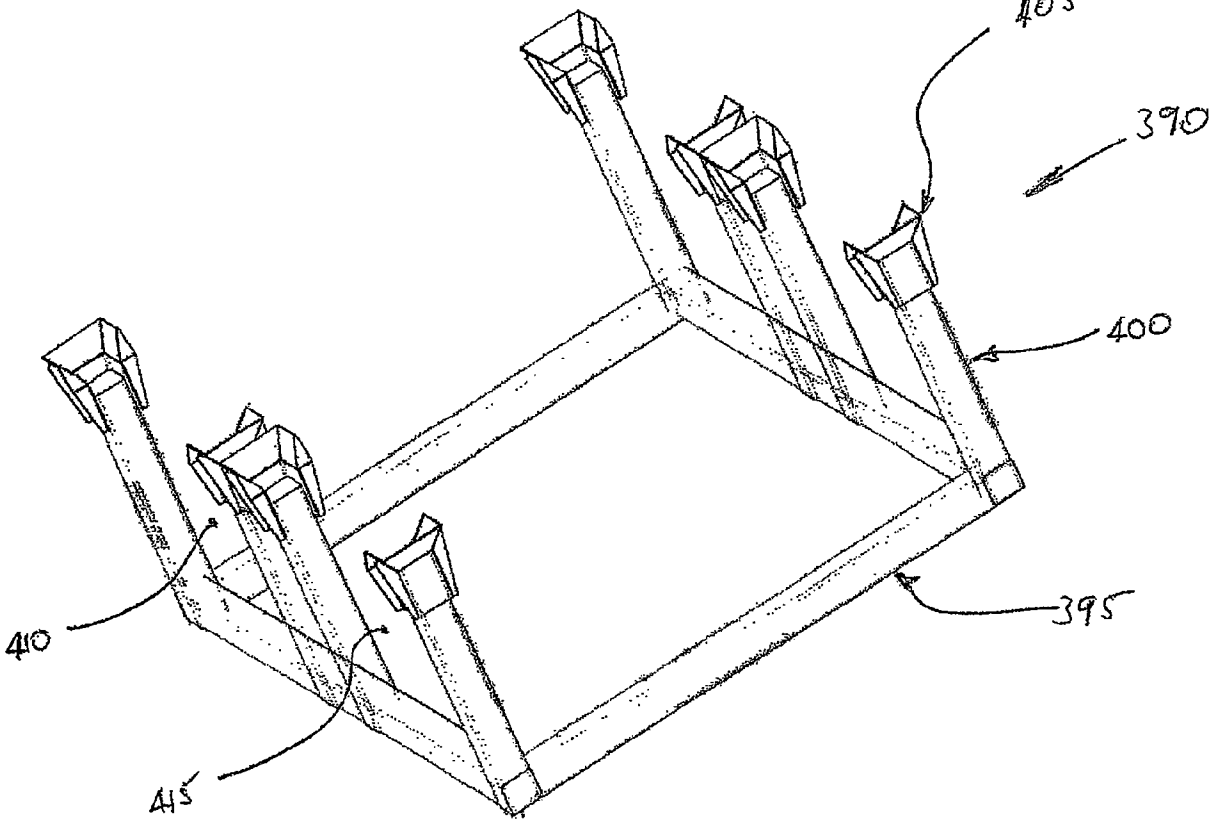
FIG. 13 is an isometric view of the support frame according to a further embodiment of the present invention.

FIG. 13 shows a support stand used to facilitate the conversion process from the single spreader arrangement to the dual spreader arrangement. The stand 390 comprises a base 395 having a plurality of upstands 400 with support portions 405 on top of each upstand 400. The upstands define two spaces 410, 415 which are sized to receive head blocks (not shown). By inserting the head blocks into the spaces 410, 415, the frame is arranged such that the head blocks bear directly on the support portion 405 rather than the underside of a spreader to which the head blocks may be mounted. Thus by maintaining a standard size head block for use with the invention, spreaders of different sizes can be used without interfering with the conversion process.

Use of the frame 390, therefore, provides an advantage in facilitating the conversion from the single spreader arrangement to the double spreader arrangement where spreaders of different size are being used. Whilst the use of the frame 390 is not essential to the conversion process, it does facilitate its conversion and further permits the conversion to take place in areas which would not normally be available.

Without the frame 390, a large flat spare such as a road way is required in order to support the head blocks and spreaders. It follows that whilst the conversion is taking place, the road way will be blocked and, therefore, may interfere with the flow of traffic within the container yard. By using the frame, the head blocks automatically align, to permit sliding of the sheaves. Further, the frame allows more convenient locations to be used for conversion such as on a beam of the quayside crane.

Figure 14A:
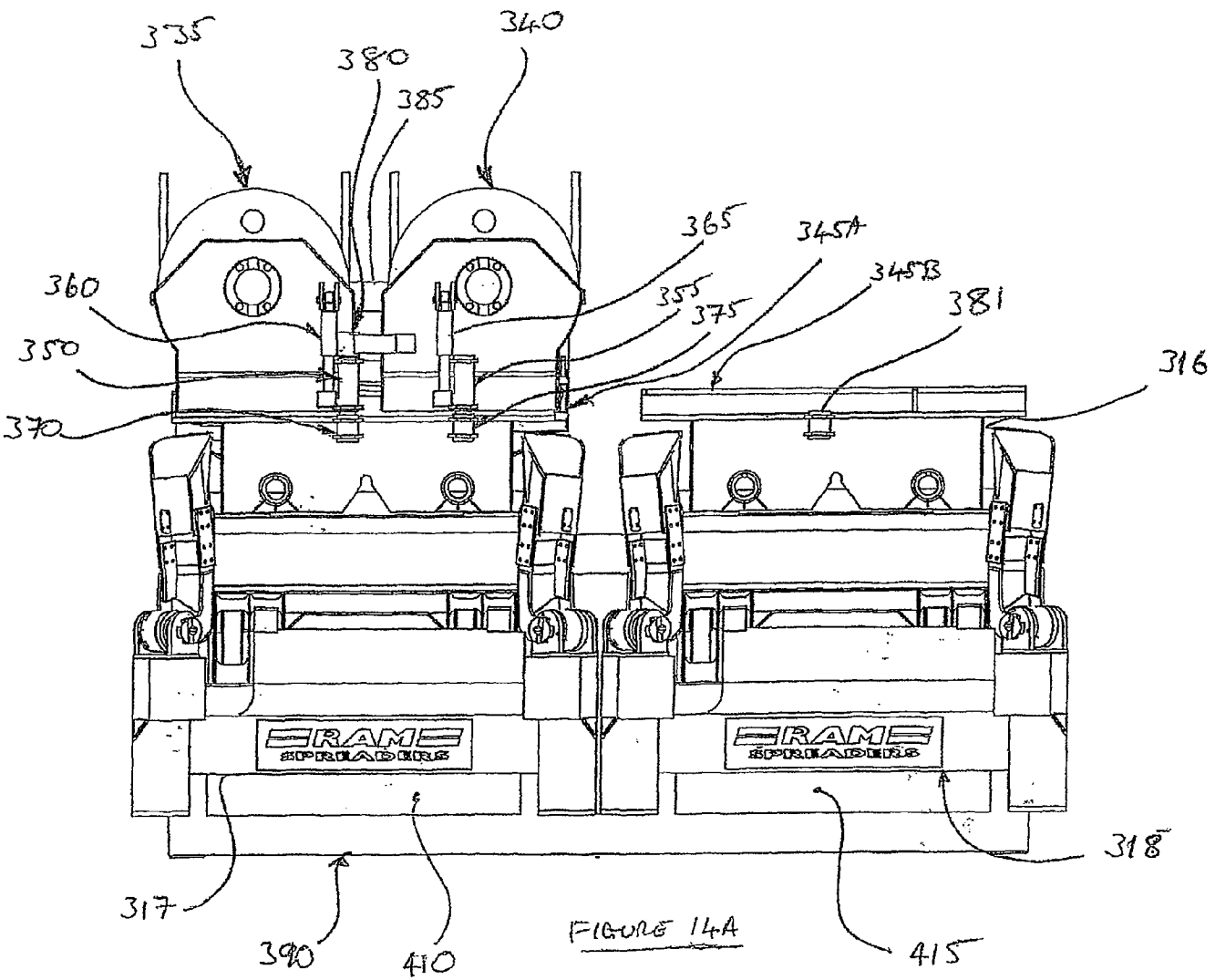
FIGS. 14A and 14B are respectively a side elevation view and an isometric view of the embodiment of FIG. 12 prior to commencement of conversion.
Figure 14B:
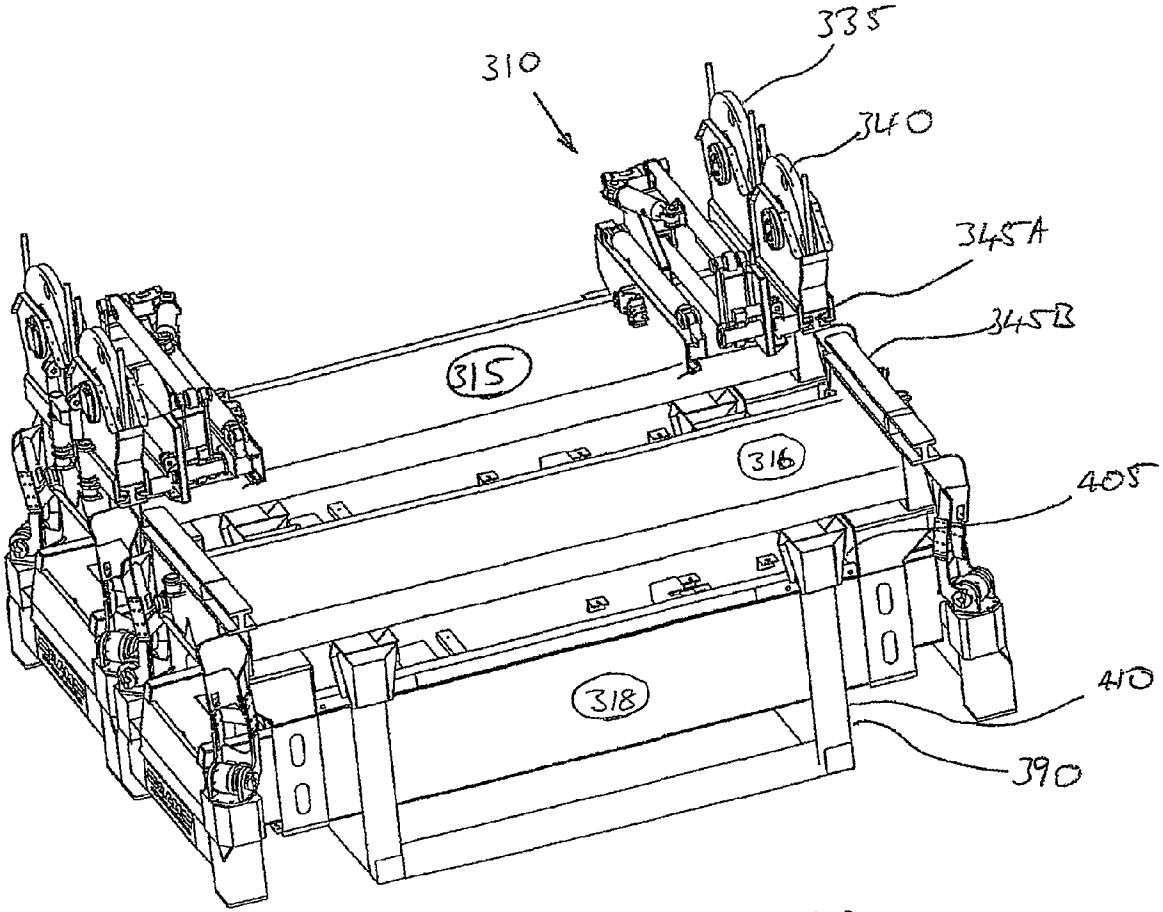

FIGS. 14A and 14B show the head block assembly just prior to the commencement of the conversion process. In this embodiment, a first head block 316 and a second head block 315 are positioned within respective spaces 415, 410 of the support frame 390. The head blocks 315, 316 are supported on an underside by support member 405 which extends passed the respective spreaders 317, 318 and so aligning the head blocks 315, 316 irrespective of the size of the spreaders 317, 318 to which they are attached. In this arrangement the frame 390 ensures alignment of the rail portions 345A, 345B which together form what is essentially a single rail upon which the first sheave 340 will slide. Thus, the frame 390 provides a further benefit in ensuring the alignment of the rail portions 345A, 345B so that the first sheave 340 can slide freely.

As can be more clearly seen in FIG. 14A, the alignment of the head blocks 315, 316 show the respective recesses 370, 375, 381 within the head blocks. These recesses define positions along the rail 345A, 345B along which the sheaves 335, 340 will slide and so engage at the various positions. The first recess 370 defines the position of the second sheave in the single spreader arrangement. The second recess 375 shows the position of the first sheave in the single spreader arrangement which also coincides with the second sheave in the dual spreader arrangement. The third recess 381 defines the position of the first sheave 340 in the dual spreader arrangement.

The conversion process commences with the first and second sheave pins 355, 350 being raised by the respective actuators 365, 360 so as to disengage from the recesses 375, 370. At this point the separating device 310 activates, such that the linear actuator 320, to which is mounted the first sheave 340 via engagement pin 330, biases the first sheave 40 so as to slide it along the rail 345A, B. As the sheaves 335, 340 are in mutual engagement through pin 350, engaging first sheave recess 380, the second sheave 335 also commences to slide.

Figure 15A:
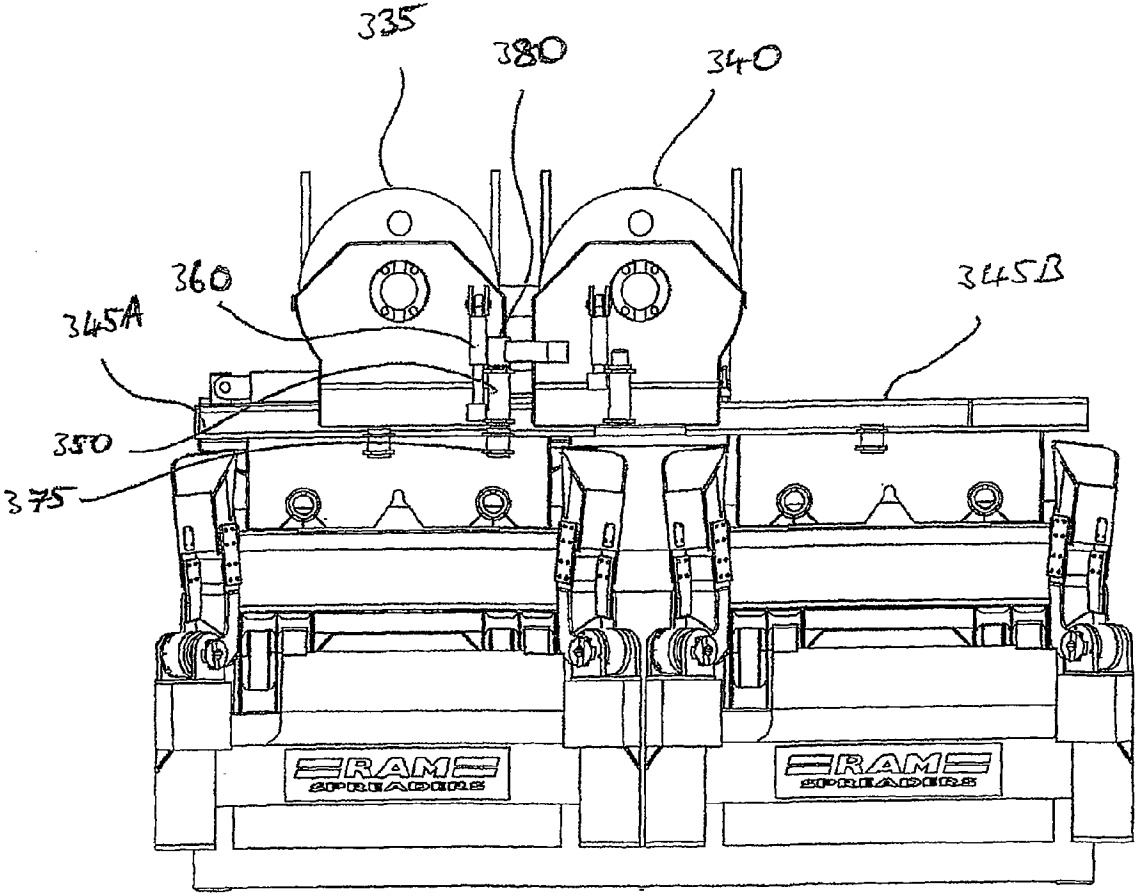
FIGS. 15A and 15B are respectively a side elevation view and an isometric view of the embodiment of FIG. 12 at the first stage of conversion.
Figure 15B:
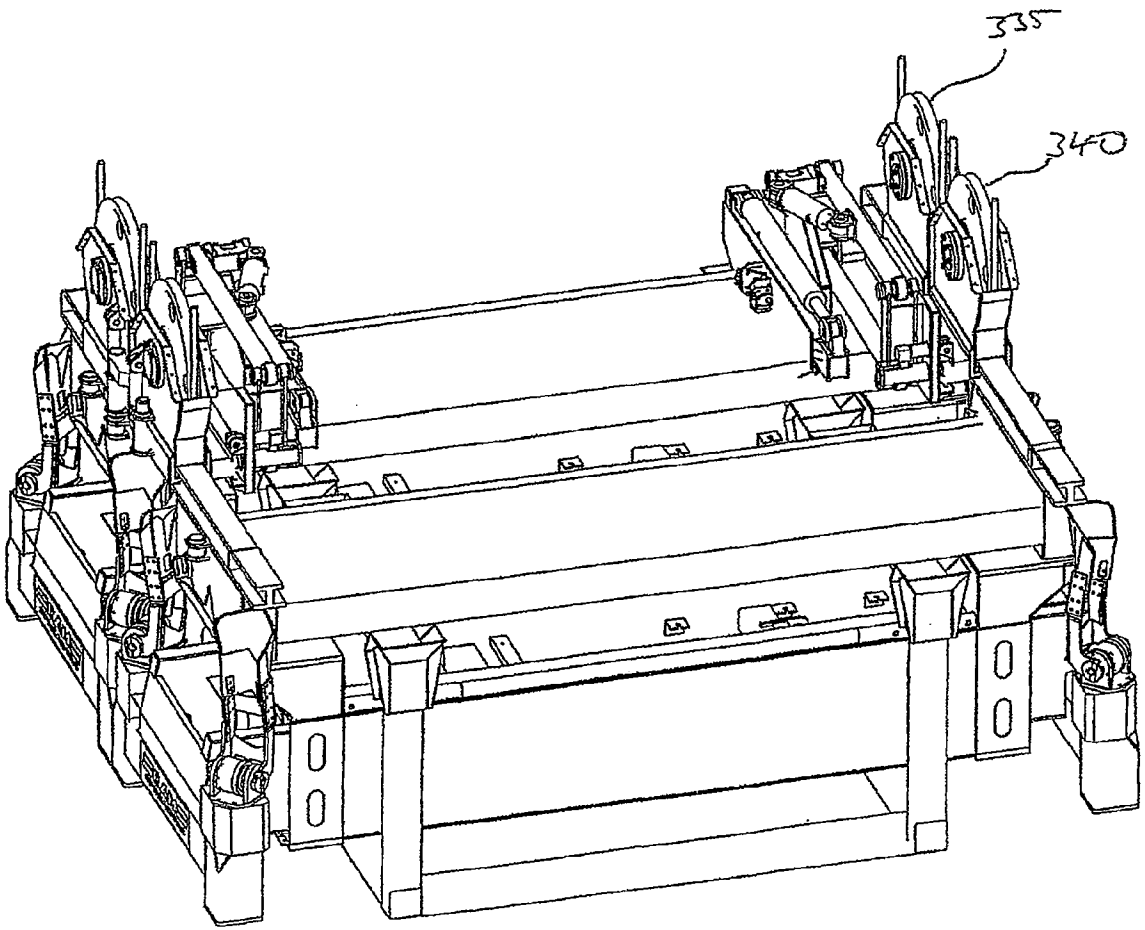

FIGS. 15A and 15B show the device as the sheaves 335, 340 reach the first position. Here the second sheave pin 350 now aligns with the second recess 375 and so placing the second sheave in the dual spreader position on the second head block 315. The actuator 360 pushes the pin 350 into its lowest most point and so engaging the second recess 375 preventing further sliding of the second sheave 335. At the same time, the second sheave pin is now out of engagement with the first sheave recess 380 and so separating the sheaves 335, 340 from further mutual sliding.

Figure 16A:
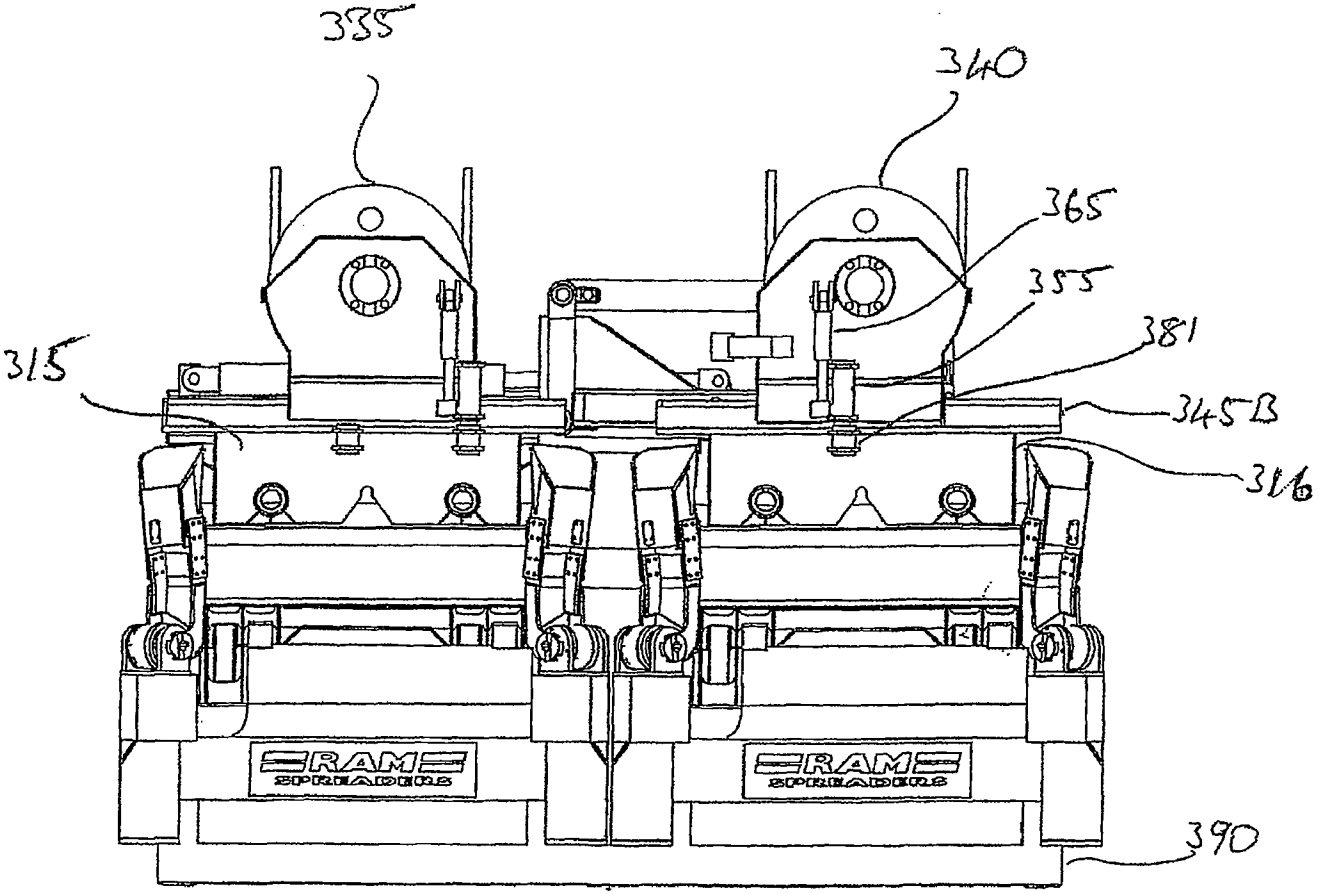
FIGS. 16A and 16B are respectively a side elevation view and isometric view of the embodiment of FIG. 12 at the second stage of conversion.
Figure 16B:
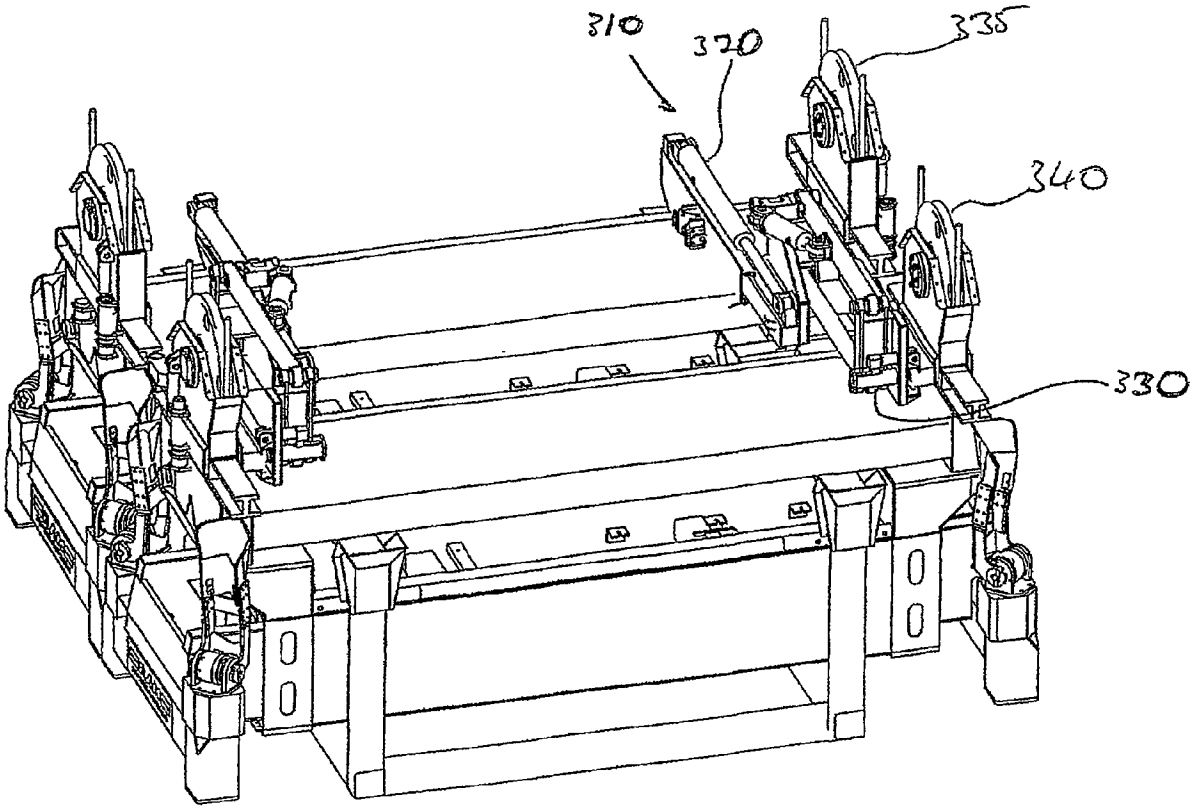

FIGS. 16A and 16B show the next stage in the conversion process whereby the first sheave 340 is now aligned with the third recess 381 in the first head block 316. Here the actuator 365 pushes the first sheave pin 355 downwards so as to engage with the third recess 381 and so preventing further sliding of the first sheave 340 along the rail 345B.

In this position the sheaves 335, 340 are positioned in the dual spreader arrangement and so if desired, the head blocks may now be lifted free from the frame 390 ready for use.

Figure 17A:
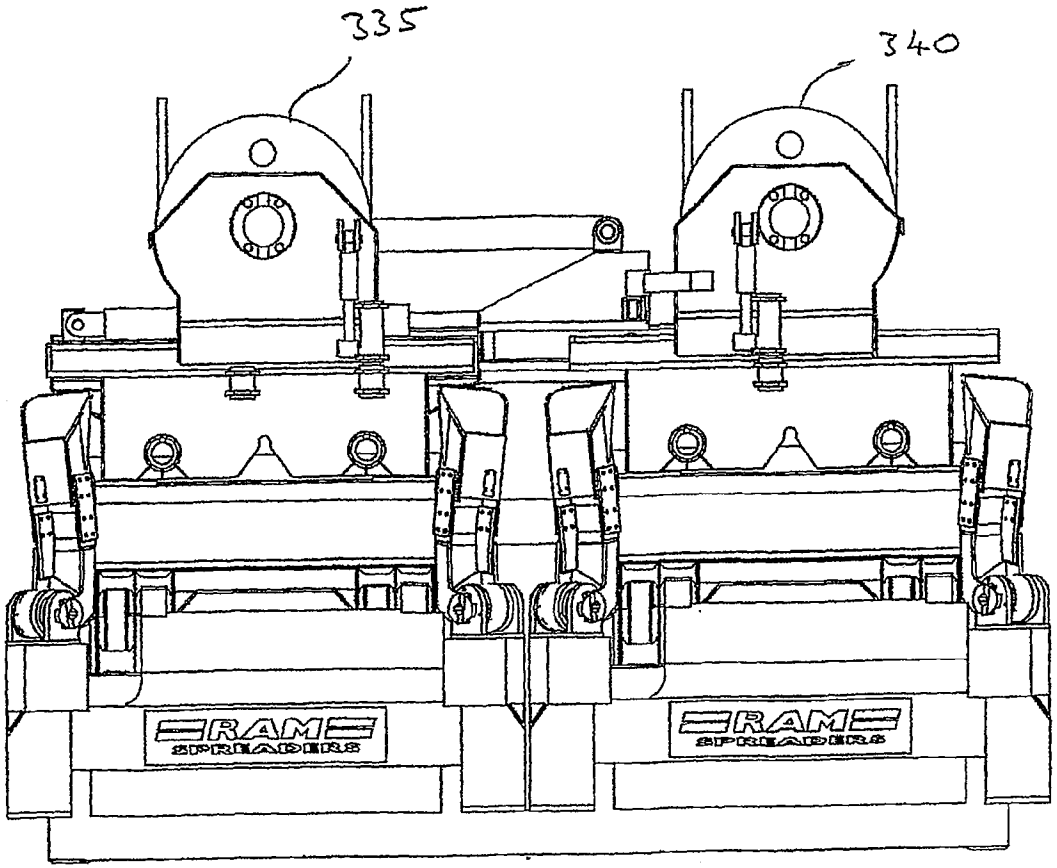
FIGS. 17A, 17B and 17C are respectively a side elevation view, an isometric view and a detailed view of the embodiment of FIG. 12 in the double spreader arrangement.
Figure 17B:
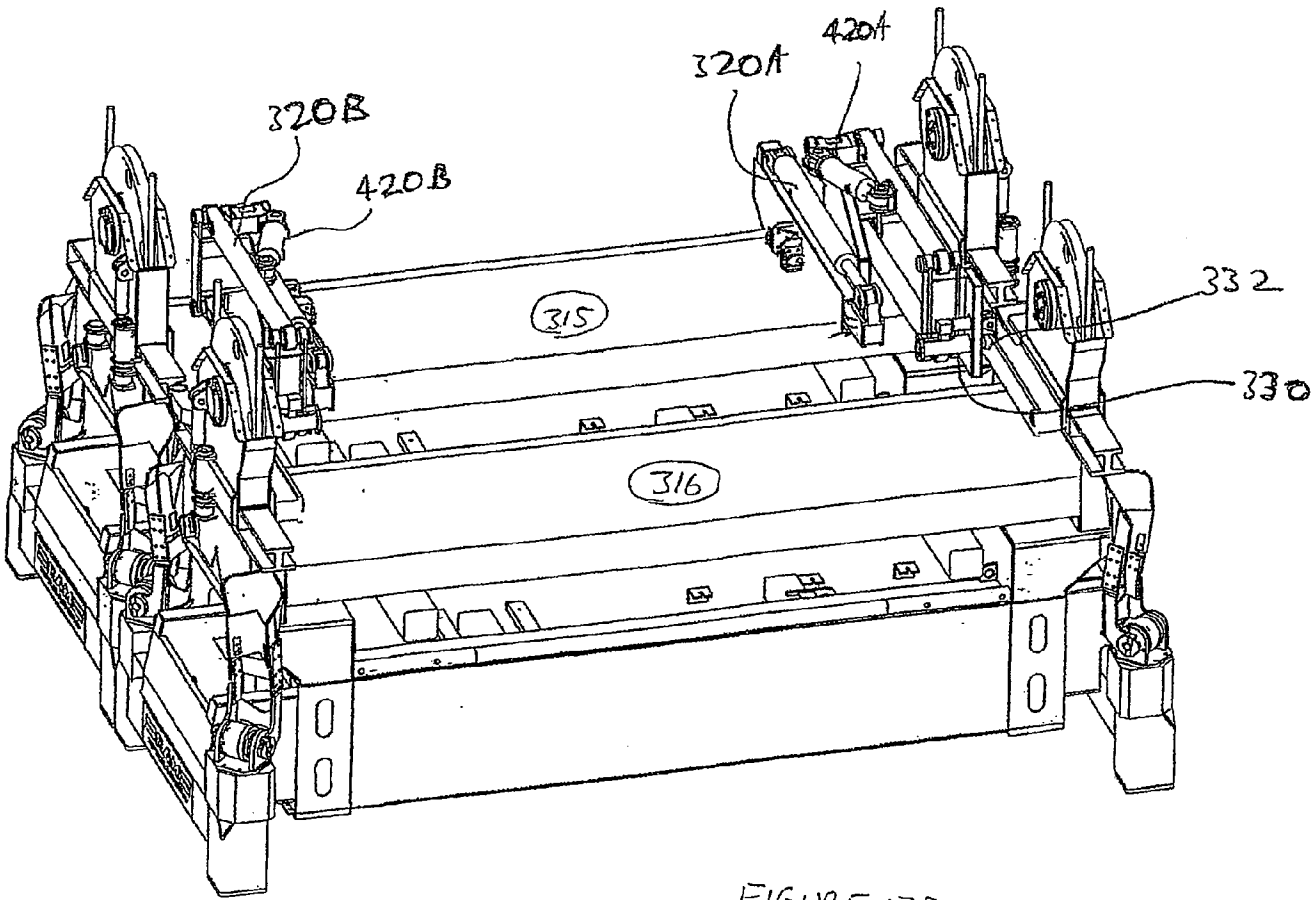
Figure 17C:
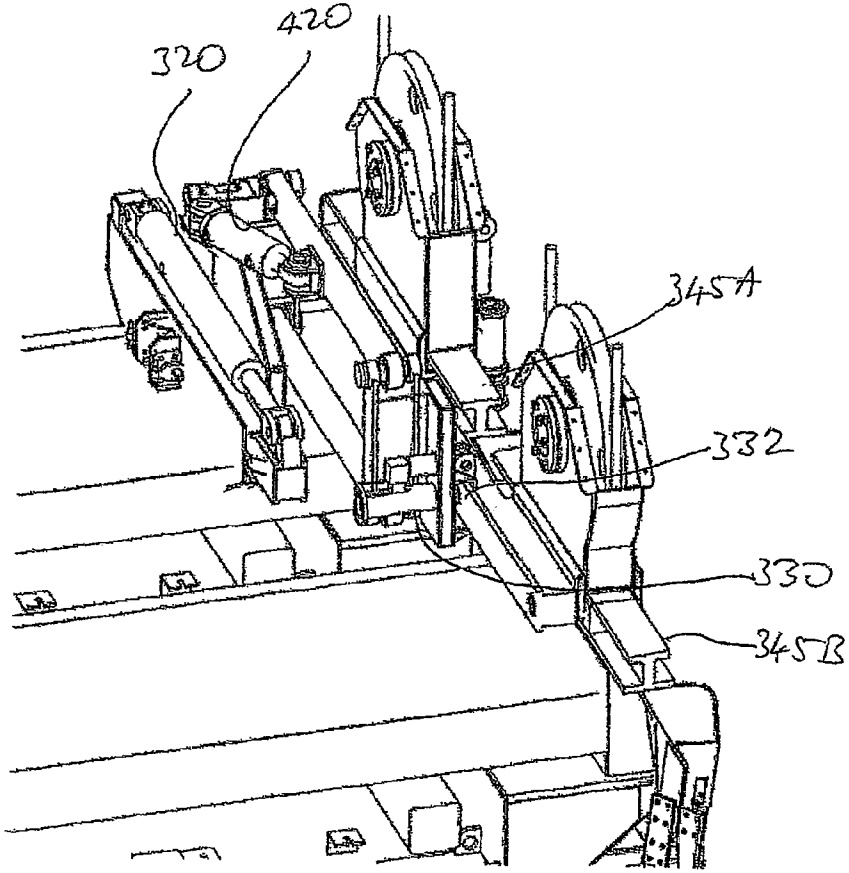

However, as the separating device 310 is fully extended, its functionality as a separating device is limited. Accordingly, the separating device must be repositioned to a usual orientation and so must retract. In order to effect this, the separating device pin 330 withdraws from the recess in the first sheave and thereby releasing, temporarily, the separating device 310 from the first head block 316. As shown in FIGS. 17A to 17C following retraction of the separating device pin 330, the separating device through retraction of the linear actuator 320 withdraws from the first head block and re-engages with a recess 332 adjacent to the second head block 315. In this position the linear actuator 320 is only partially extended and thus has the substantial stroke available to the actuator available to it for effecting the relative movement of the head blocks 315, 316.

In this orientation several modes of relative movement are available including lateral separation by extending both linear actuators at the same time and for the same distance. Skewing of the head blocks 315, 315 can be achieved by differential extension or retraction of the linear actuators 320A, 320B. An offset of the head blocks 315, 316 can be effected by use of the offset actuators 420A, 420B and so moving the head blocks 315, 316 relative to each other parallel to the longitudinal axes of said head blocks.

The invention claimed is:

1. A head block assembly comprising a first head block having a first pair of cable engaging sheaves;

a second head block having a second pair of cable engaging sheaves;

a separation device mounted intermediate the first and second head blocks, for effecting relative transverse movement of said head blocks;

wherein the first pair of sheaves are selectively disengagable from the first head block, and selectively engagable with the second head block.

2. The assembly according to claim 1, wherein the separation device moves the head blocks between a retracted position, whereby the head blocks are proximate, and an extended position, whereby the head blocks are distal.

3. The assembly according to claim 2, wherein the first head block includes a first rail portion and the second head block includes a second rail portion, the rail portions corresponding to each sheave on said head blocks, with respective first and second rail portions aligning when the head blocks are in the retracted position.

4. The assembly according to claim 3, wherein each of the first pair of sheaves are mounted on the first rail portion, such that on disengaging said first pair of sheaves, the first pair of sheaves is slidable from the first head block toward the second head block along said rail portions.

5. The assembly according to claim 3, wherein each of the second pair of sheaves are mounted on the second rail portion, such that on disengaging said second pair of sheaves, the second pair of sheaves is slidable from the second head block toward the first head block along said rail portions.

6. The assembly according to claim 1, wherein the sheaves are attached to the respective head blocks using selectively removable sheave pins.

7. The assembly according to claim 1, wherein the second head block is capable of engaging both pairs of sheaves.

8. The assembly according to claim 7, wherein each sheave is mounted to the second head block by coupling to both the second head block and to an adjacent sheave.

9. The assembly according to claim 1, wherein the separation device includes at least two projection arms, each located adjacent one of each of the first pair of sheaves.

10. The assembly according to claim 9, wherein each projection arm includes a linear actuator and a parallelogram linkage such that the actuator is mounted to the first head block at a first end and to the linkage at a second end.

11. The assembly according to claim 10, wherein the linkage is fixedly mounted to the first head block and releasably mounted to the second head block.

12. The assembly according to claim 11, wherein the releasable mounting includes a plurality twist lock devices attached to the linkage, which are engagable with a bracket mounted to the second head block.

13. The assembly according to claim 10, wherein the linkage is fixedly mounted to the first head block and releasably mounted to the second pair of sheaves.

14. The assembly according to claim 13, wherein the releasable mounting includes a connection pin acting as a selectively removable shear key between the linkage and the second pair of sheaves.

15. The assembly according to claim 10, wherein on disengagement of the first pair of sheaves and demounting of the linkages, the first head block is detached from the second head block.

16. The assembly according to claim 1 further including discrete first and second pairs of rail portions, the first pair of rail portions mounted to the first head block and the second pair of rail portions mounted to the second head block, said first and second sheaves in sliding engagement with said rail portions.

17. The assembly according to claim 16, wherein the sheaves are slidable between the head blocks along said rails when the head blocks are aligned in side by side relation.

18. The assembly according to claim 17, wherein the second head block is capable of engaging both pairs of sheaves, whereupon the first head block is disengaged from the assembly.

19. The assembly according to claim 18, wherein each sheave includes a vertically displaced shear pin for selectively fixing said sheave against sliding along said rail.

20. The assembly according to claim 19, wherein the first head block includes a central recess and the second head block includes an offset recess and a central recess each arranged to receive the vertically displaced shear pins.

21. The assembly according to claim 20, wherein engagement of the first sheave with the central recess of the first head block and engagement of the second sheave with the central recess of the second head block permits use of the assembly to simultaneously engage two spreaders.

22. The assembly according to claim 20, wherein engagement of the first sheave with the central recess of the second head block and engagement of the second sheave with the offset recess of the second head block permits use of the assembly to engage a single spreader.

23. The assembly according to claim 1, wherein the separation device includes at least two projection arms, each located adjacent one of each of the first pair of sheaves.

24. The assembly according to claim 23, wherein a linkage is fixedly mounted to the second head block and releasably mounted to the first head block.

25. The assembly according to claim 24, wherein the releasable mounting to the first head block includes a first mounting to slide the first sheave to the first head block, and a second mounting to effect separation of the head blocks.

* * * * *